US007900574B2

(12) United States Patent
Henricson

(10) Patent No.: US 7,900,574 B2
(45) Date of Patent: Mar. 8, 2011

(54) DEVICE AT A TRANSFORMABLE BOAT

(76) Inventor: Alve Henricson, Stockholm (SE)

( * ) Notice: Subject to any disclaimer, the term of this patent is extended or adjusted under 35 U.S.C. 154(b) by 141 days.

(21) Appl. No.: 12/294,924

(22) PCT Filed: Jul. 12, 2007

(86) PCT No.: PCT/SE2007/050521

§ 371 (c)(1),
(2), (4) Date: Oct. 7, 2008

(87) PCT Pub. No.: WO2008/018829

PCT Pub. Date: Feb. 14, 2008

(65) Prior Publication Data

US 2010/0043693 A1 Feb. 25, 2010

(30) Foreign Application Priority Data

Aug. 9, 2006 (SE) ..... 0601662

(51) Int. Cl.
*B63B 7/04* (2006.01)

(52) U.S. Cl. ..... 114/353; 114/352

(58) Field of Classification Search ..... 114/352, 114/353, 354

See application file for complete search history.

(56) References Cited

U.S. PATENT DOCUMENTS 1,527,089 A * 2/1925 Shipley ..... 114/353
1,932,245 A 10/1933 Horak
2,287,055 A * 6/1942 Olson ..... 114/344
2,422,930 A * 6/1947 Rutledge ..... 114/353
2,659,464 A * 11/1953 Sweetman ..... 114/353
3,684,139 A * 8/1972 Johnson ..... 114/353
4,366,769 A * 1/1983 Lingeman ..... 114/352
4,794,876 A * 1/1989 Levine ..... 114/352
5,257,594 A * 11/1993 Methven ..... 114/354

(Continued)

FOREIGN PATENT DOCUMENTS

DE 4233526 A1 4/1994

(Continued)

OTHER PUBLICATIONS

Swedish Patent Office, International Search Report in PCT/SE2007/050521, Nov. 29, 2007.

*Primary Examiner*—Lars A Olson
(74) *Attorney, Agent, or Firm*—Potomac Patent Gourp PLLC

(57) ABSTRACT

The invention relates to a device in the form of a transformable craft (1). It consists of two or three sections held together, a middle part (10) and one or two end parts (stem and stem) (8, 9). When a so-called "Container & Boat"™ forms a boat, the end parts (8, 9) constitute an extension of the middle part (10). The end parts (8, 9) can be turned up 180° and be fitted into spaces intended therefor on the middle part (10). The result becomes a container (C). Container fittings (4) are placed in the corners underneath the middle part (10), while the end parts (8, 9) are provided with two container fittings (5) each. When a C & B is a boat and the end parts (8, 9) are lowered, the container fittings thereof are in the bottom. When a C & B is a container and the end parts (8, 9) are raised, the container fittings (5) thereof are on the topside.

15 Claims, 28 Drawing Sheets

U.S. PATENT DOCUMENTS

Figure 1:
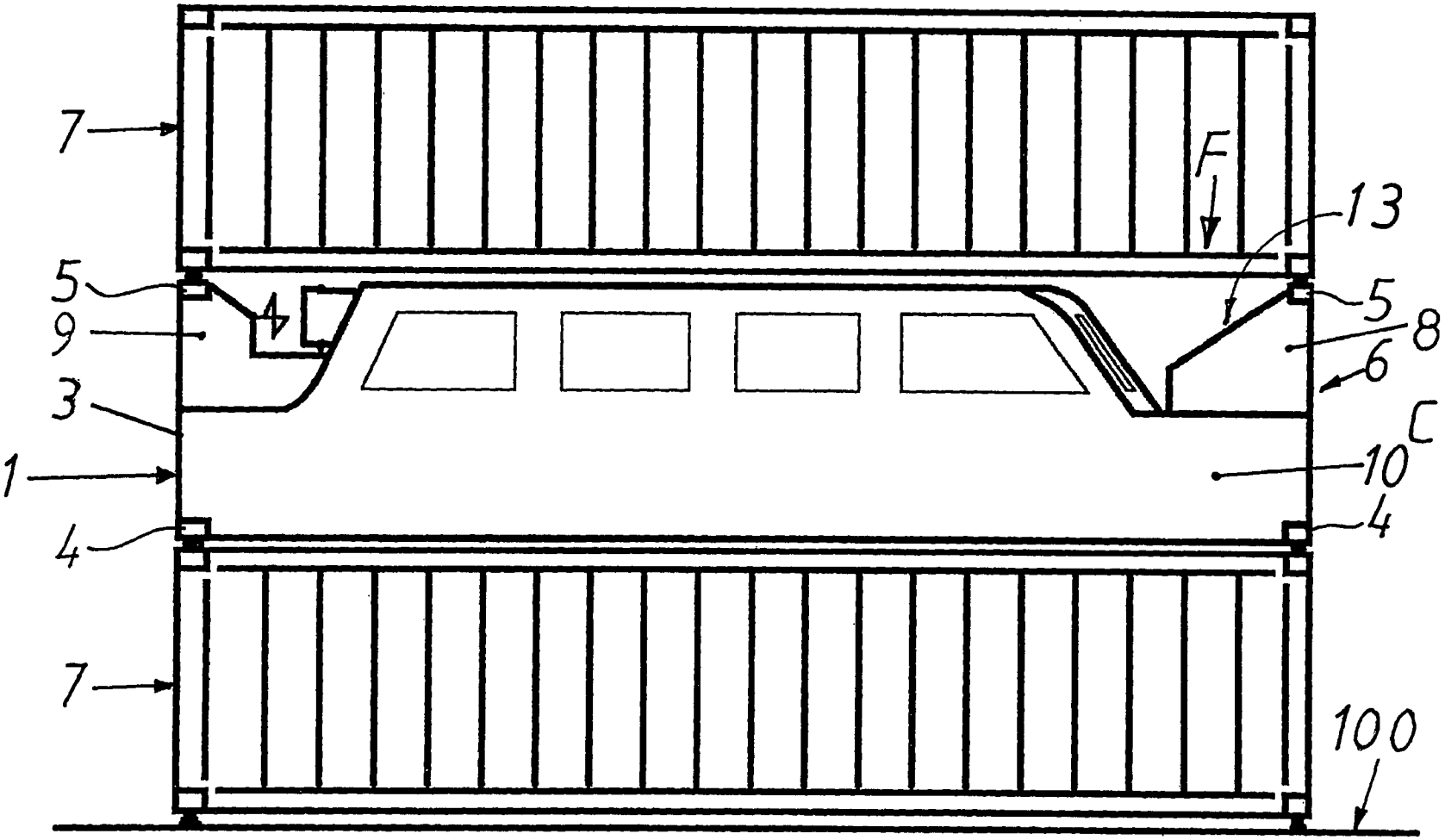

| | | | | |
|---|---|---|---|---|
| 5,642,686 | A | 7/1997 | Jeswine | |
| 6,283,057 | B1 | 9/2001 | Ellis et al. | |
| 6,612,255 | B1 * | 9/2003 | Wragg | 114/352 |

FOREIGN PATENT DOCUMENTS

| | | | |
|---|---|---|---|
| DE | 19963423 | A1 | 7/2001 |
| WO | 03/076263 | A1 | 9/2003 |
| WO | 2005/087580 | A1 | 9/2005 |

* cited by examiner

DEVICE AT A TRANSFORMABLE BOAT

The present invention relates to a device at a transformable craft that, in the respective transformed state, is arranged to function as a floating ship and, together with an additional transformable craft and/or container, as a unit intended for stacking, respectively, a number of parts of the craft being movably actuatable for the transformation into a ship and into a unit intended for stacking, respectively.

In countries having canal systems, navigable rivers and other watercourses, it is quite common that crafts are utilized in the form of houseboats as housing. These boats are generally built and intended for smaller and calm and protected waters and not for the sea and the like. Therefore, if it is desired to move them to other continents or canal systems, one is obliged to let transport them as part loads/general goods on a lorry, train or ship. There are also specially adapted ships for boat transportation, so-called "yacht carriers". The costs for boat transportation are high and it is also very complicated with special appliances for the transports.

It is from, for instance, WO 03/076263A previously known to let transport containers onboard a craft that is formed of foldable parts and that, in the assembled storage state, form a container-like unit intended for stacking. A craft arranged in such a manner is more to be compared with a surrounding floating facility situated underneath, similar to a floating collar for a container transportable on water, than a craft, and that lacks its own propulsion unit. Neither is it possible to propel said floating facility by its own engines or that a living space and/or another hold is onboard the same. It is simply formed of a towable "container floating collar" and not of any craft that can have, e.g., living spaces or other cargo spaces onboard in a similar way as in boats, and in that connection be able to operate as an independent ship when arranged in the so-called "ship state". From DE 4233526 A1, it is also previously known to let convert a container into a craft. However, the craft is essentially formed of the proper container, but it is possible to let fit loose appliances, such as, e.g., a wheelhouse or couple together a plurality of entire containers into a common craft. See FIG. 3 in DE 4233526 A1.

The hydrodynamic properties of such a craft are not so good, and it becomes complicated and always requires that a plurality of containers are in place, which makes that large spaces are required only to store and transport this very craft. However, said known solutions solve the problem of allowing to adapt the crafts also to container traffic and also to be classified as containers. This makes it possible to considerably reduce the transportation costs and radically simplify the logistics.

Therefore, the main object of the present invention is primarily to solve, among other things, the problems mentioned above with a transformable craft by simple means, and which also allows the craft to get good sea-going qualities to be run in water and also good container-stacking properties.

Said object is attained by means of a device according to the present invention, which essentially is characterized in that at least one end part (stem or stern) of the craft is lowerable and raisable, respectively, and turnably mounted to a middle part of the craft forming an extension of the middle part, said turnable end part and/or supports of the middle part supporting container fittings, and that said end part has a shape that imparts the craft good fluid mechanics in water.

Figure 2:
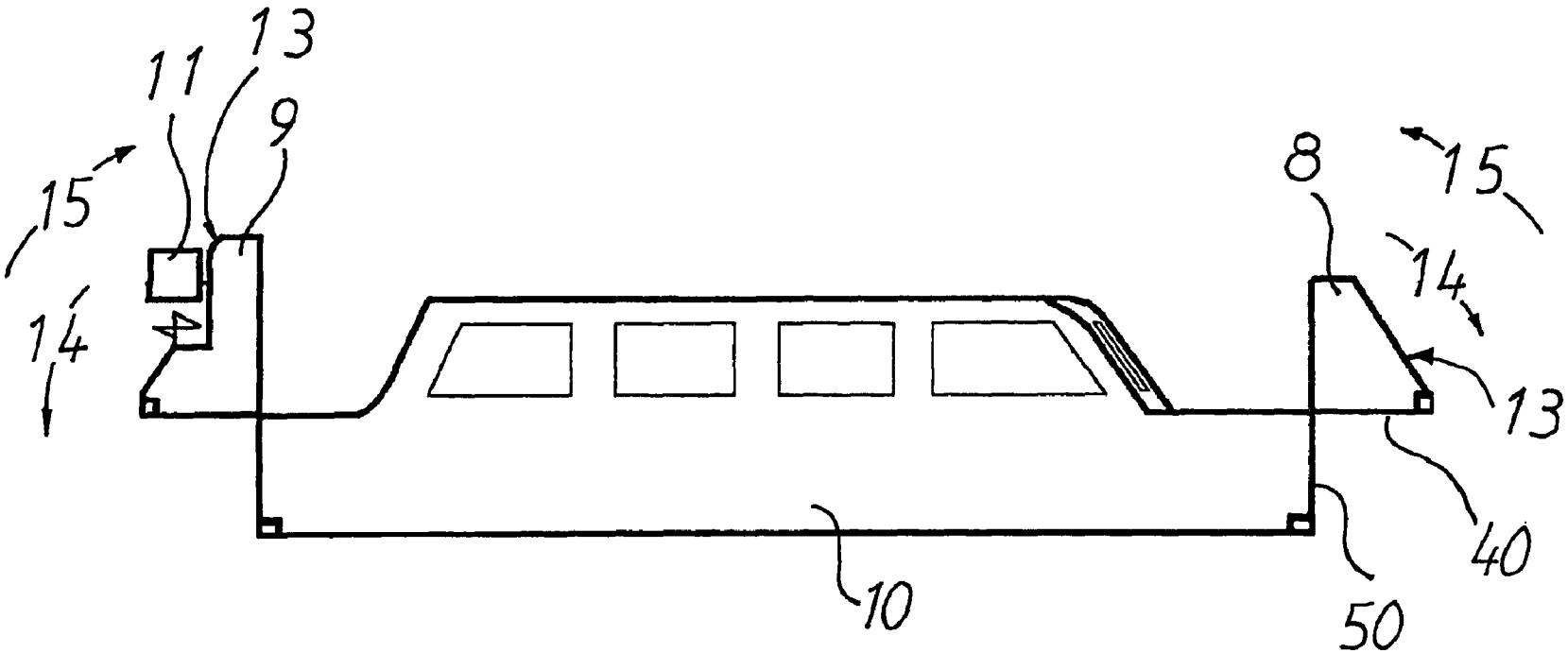
Figure 3:
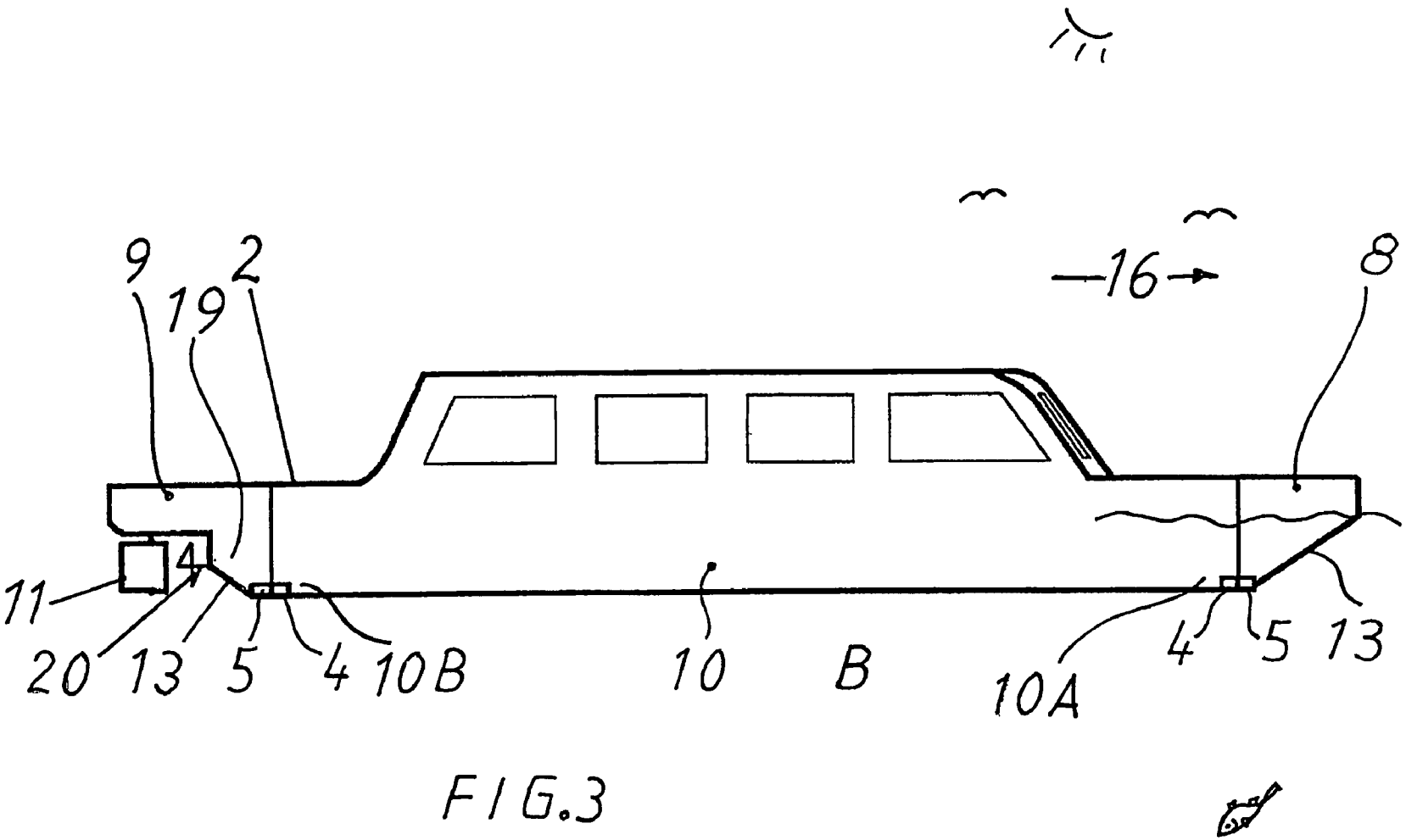
Figure 4:
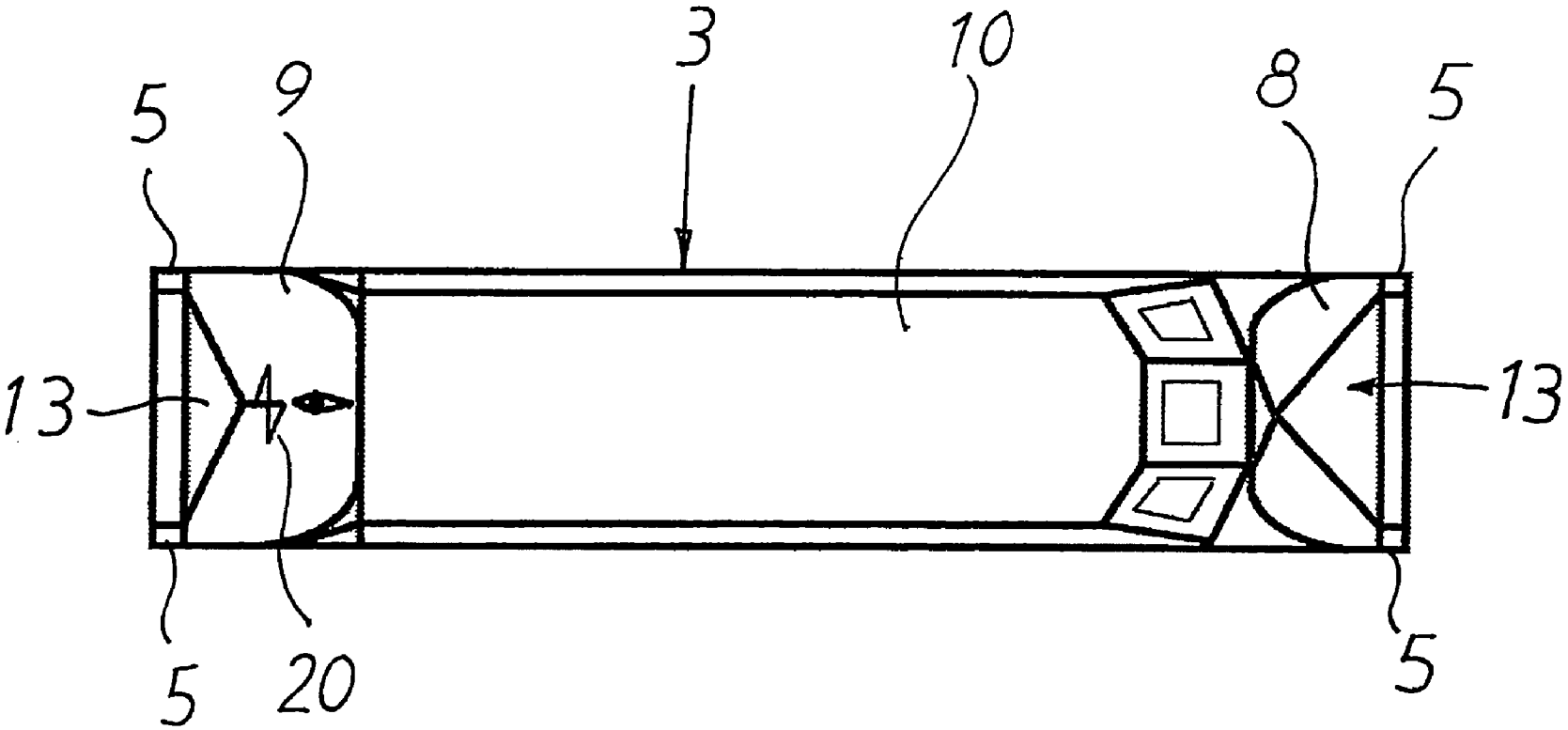
Figure 5:
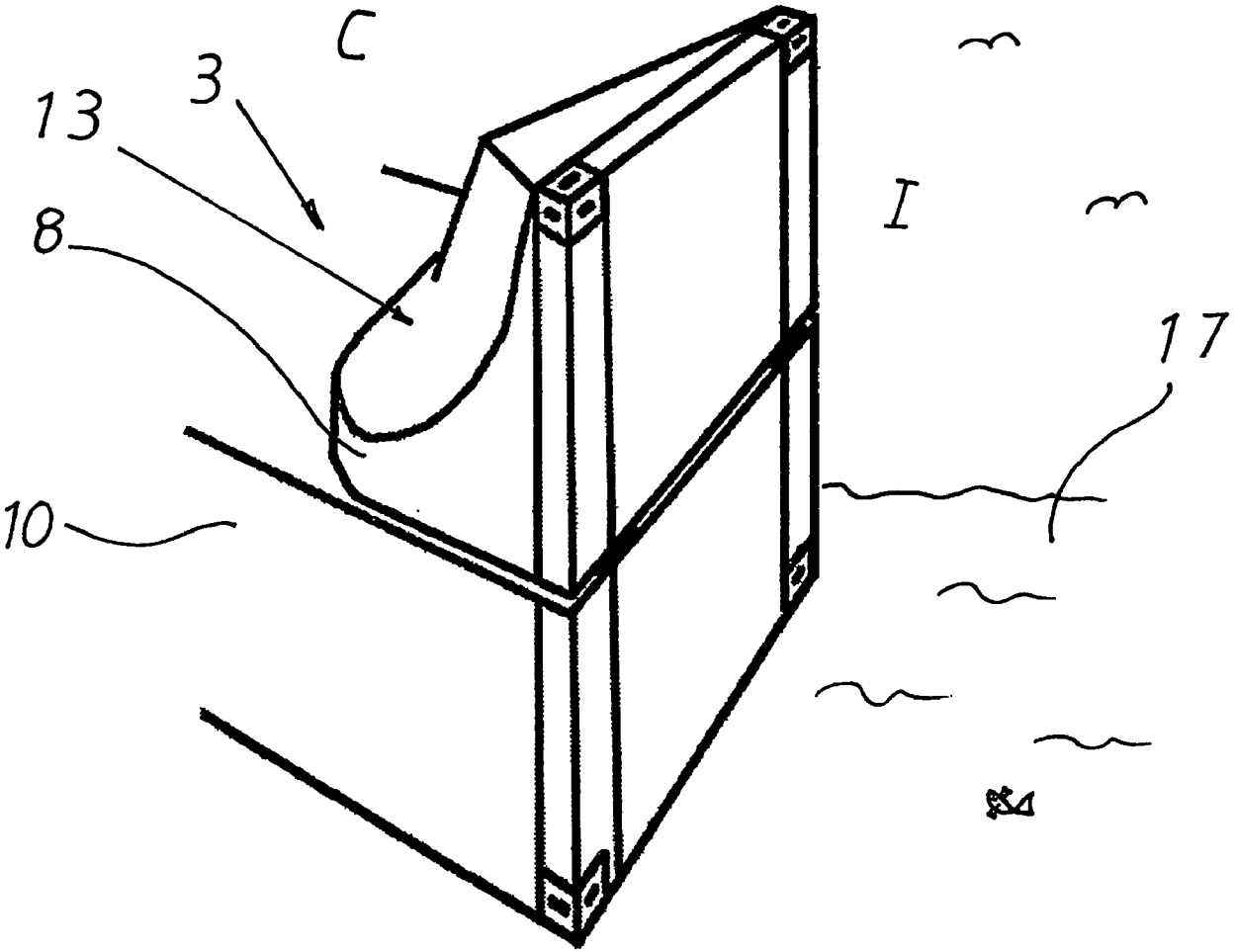
Figure 6:
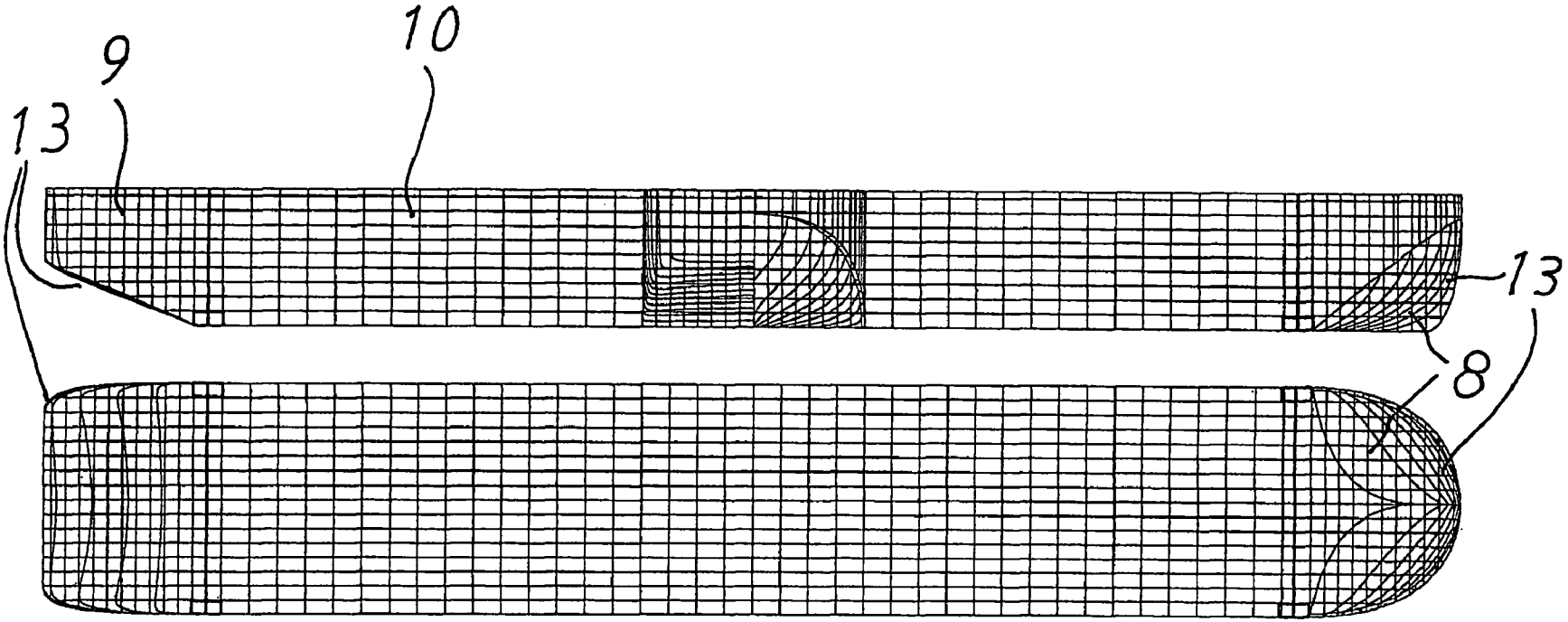
Figure 10:
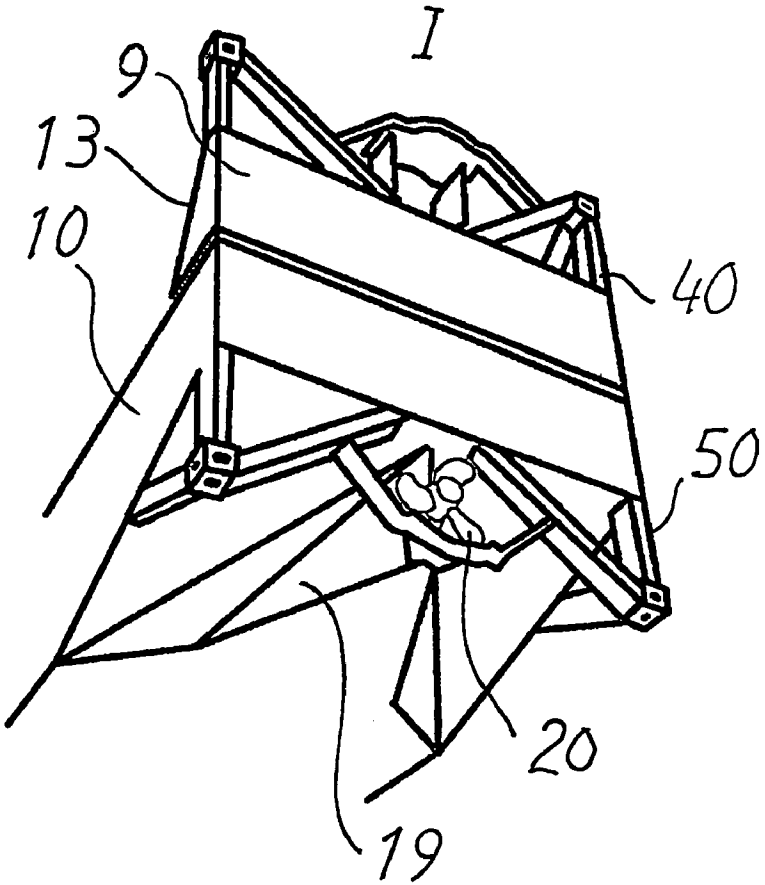
Figure 11:
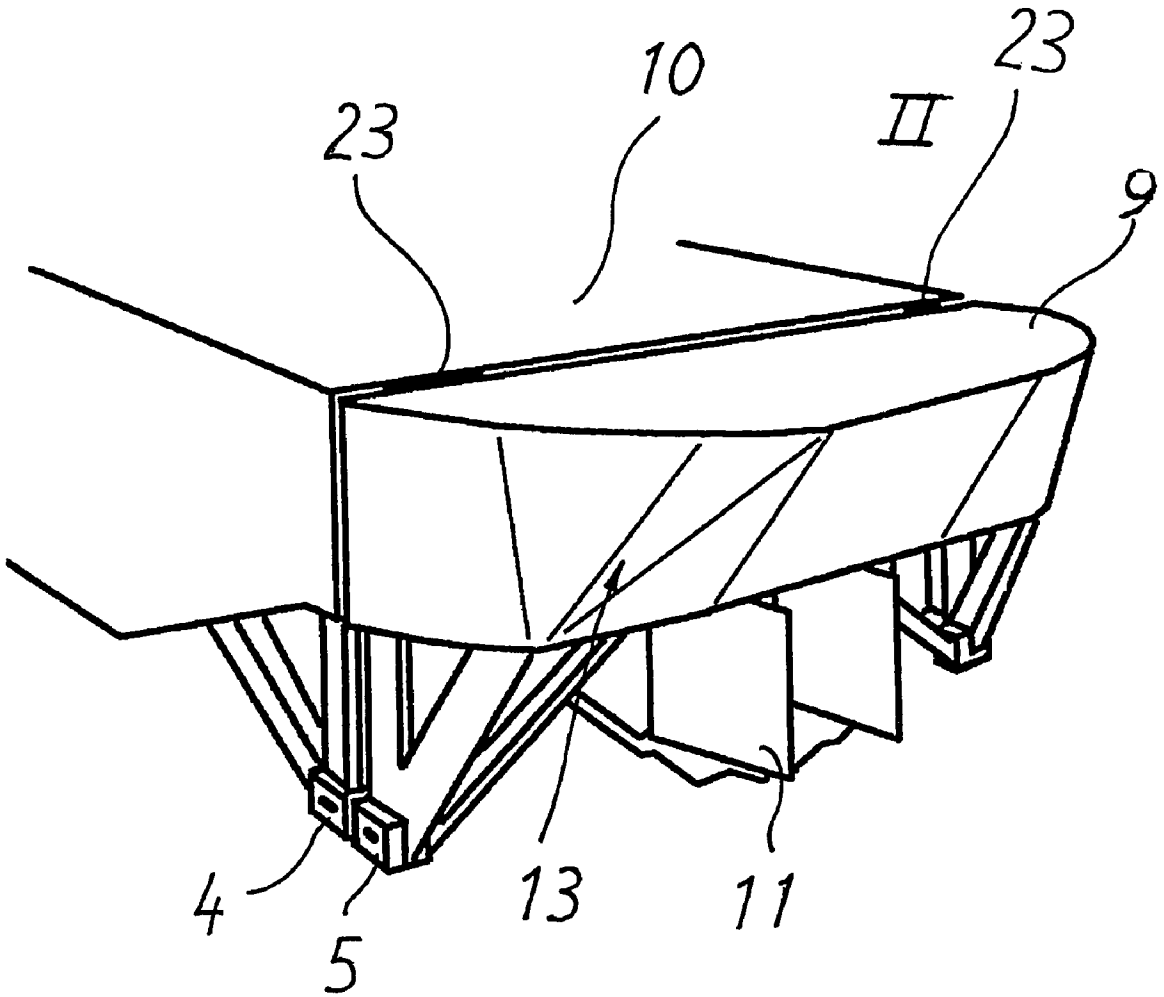
Figure 12:
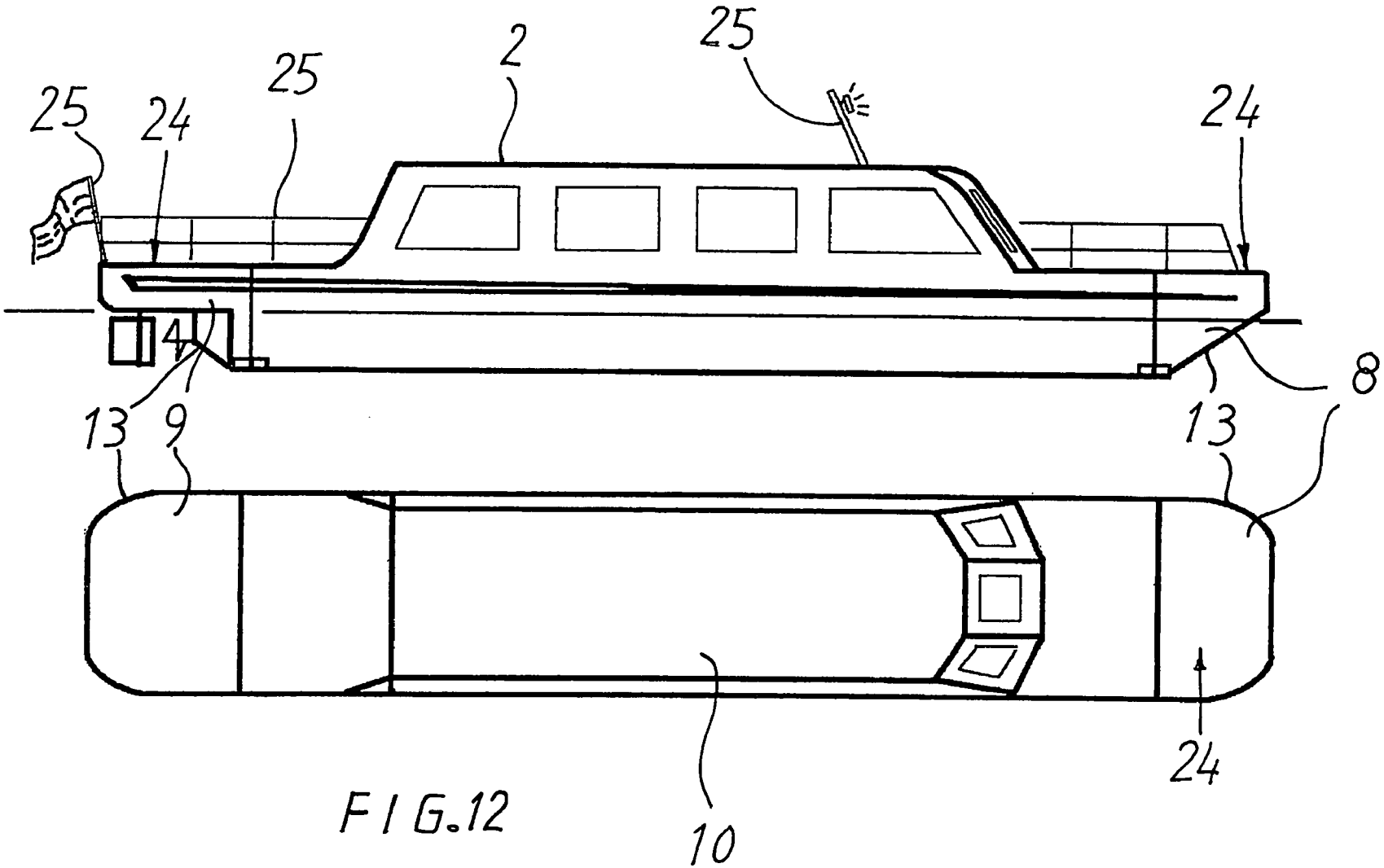
Figure 13:
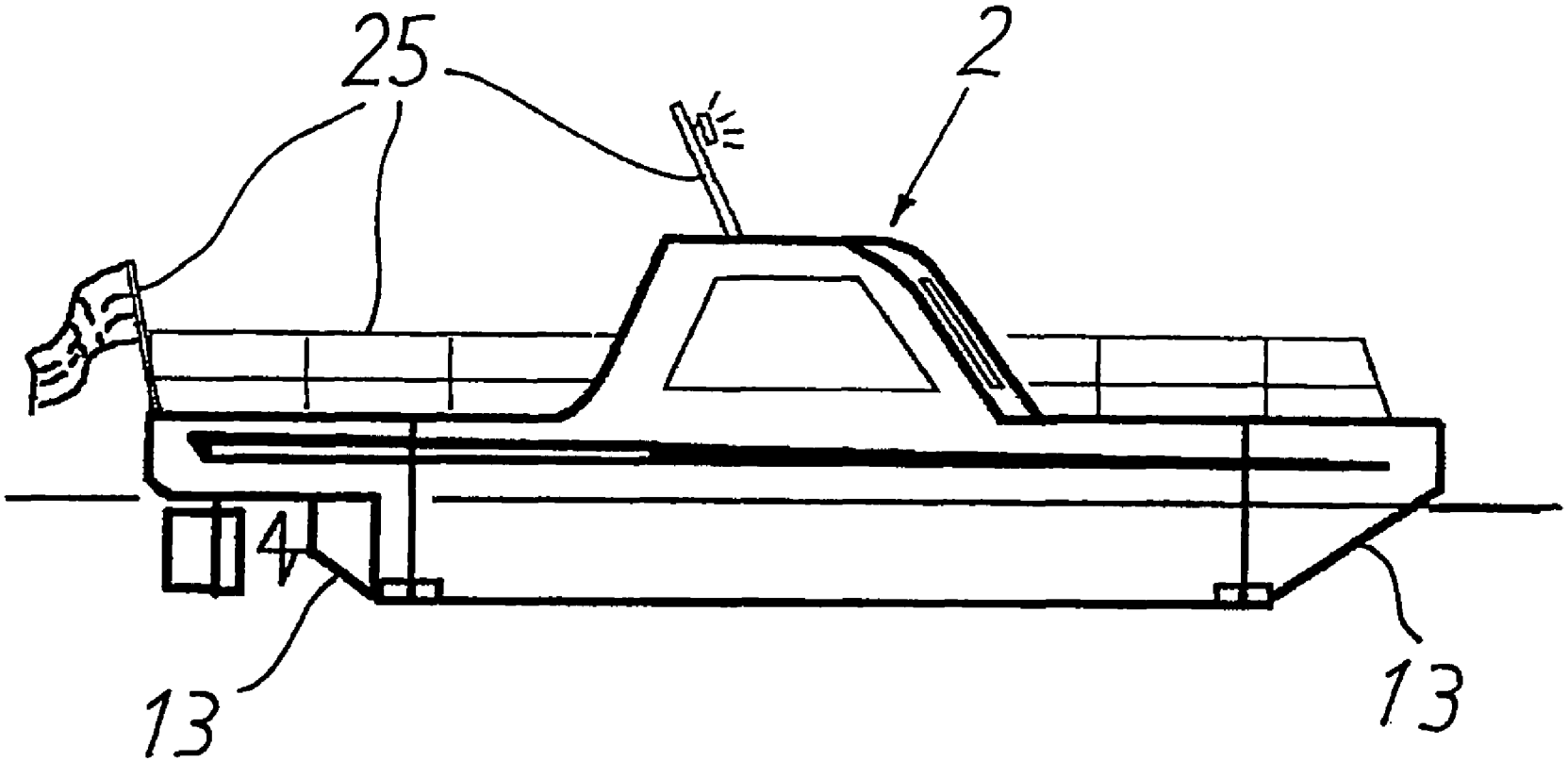
Figure 14:
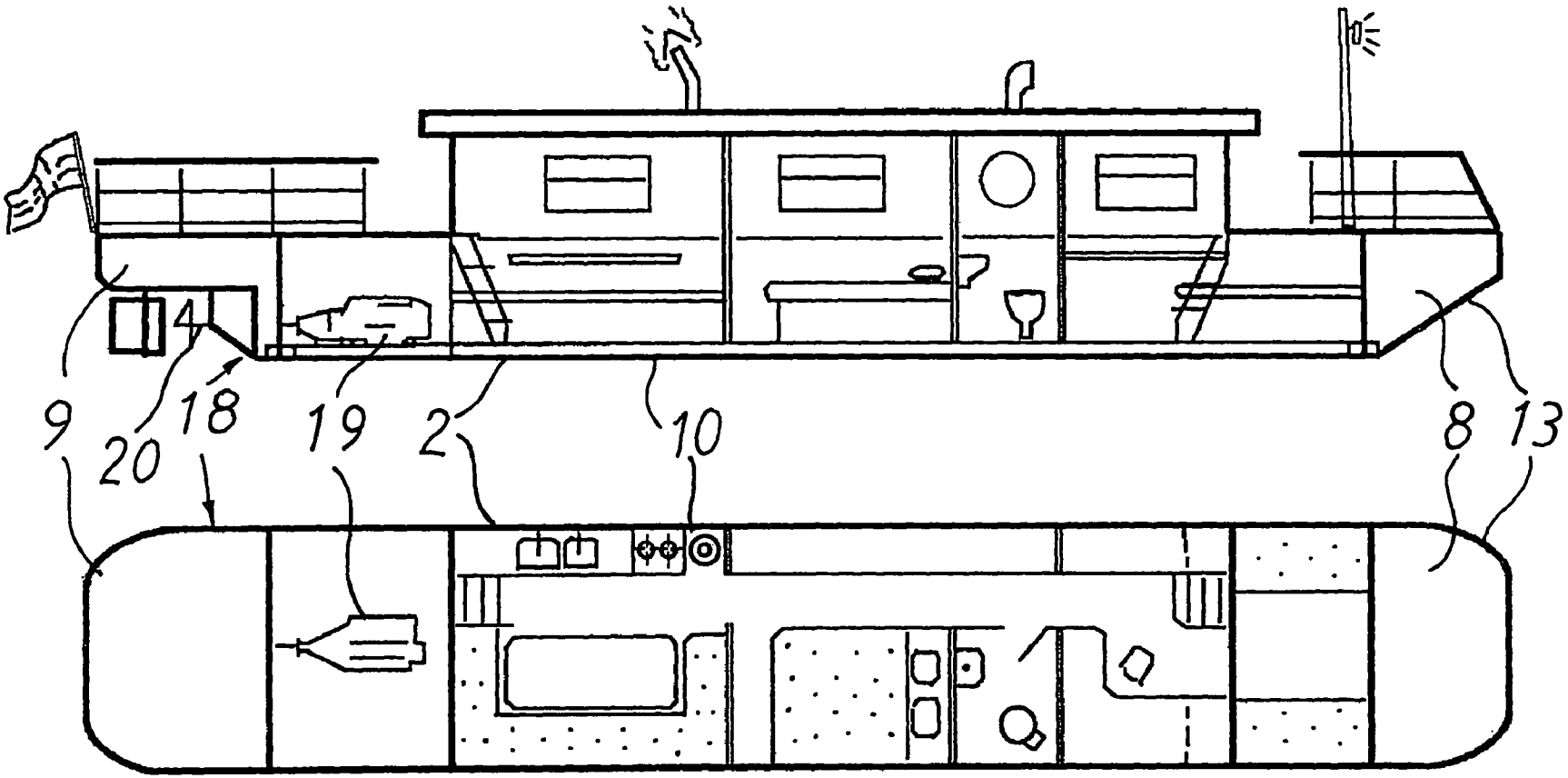
Figure 15:
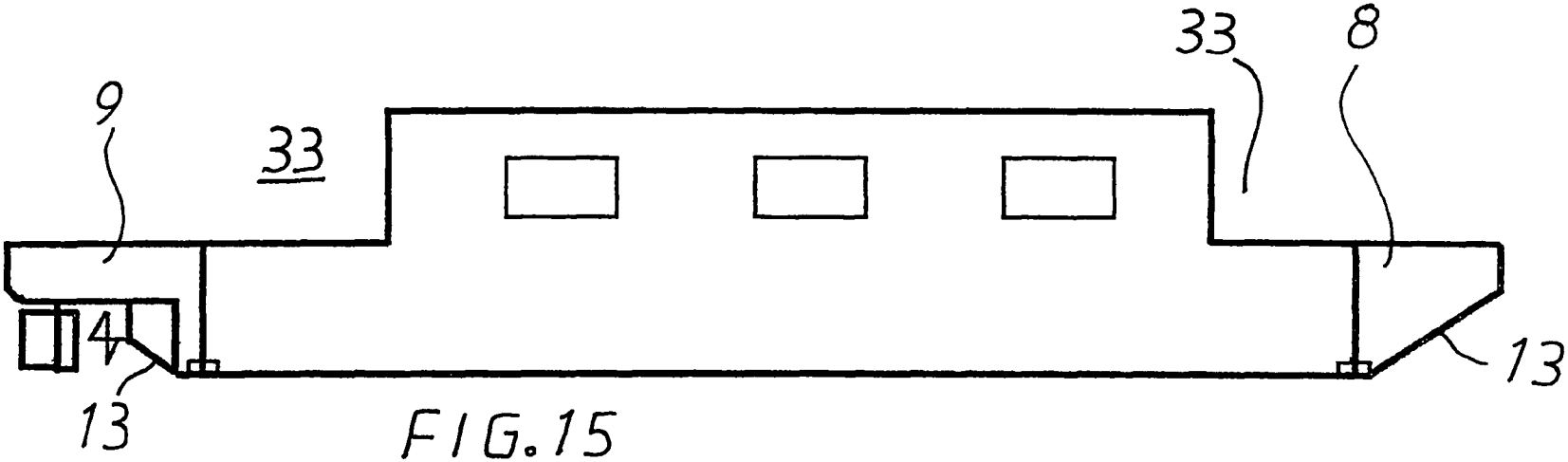
Figure 16:
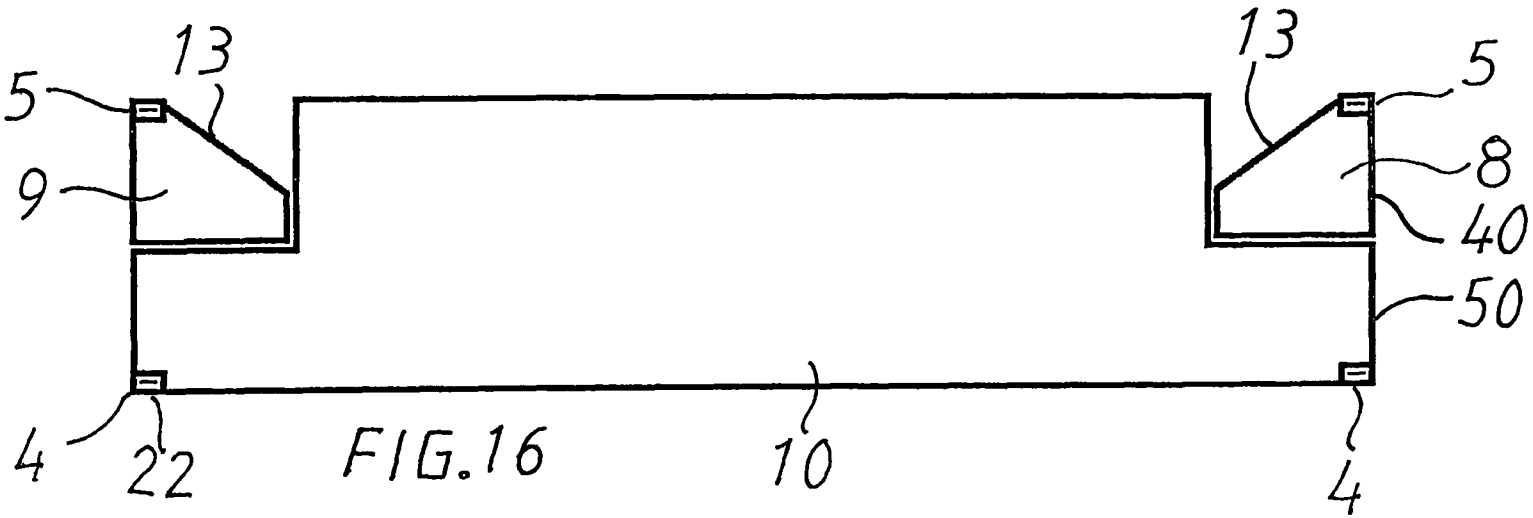
Figure 21:
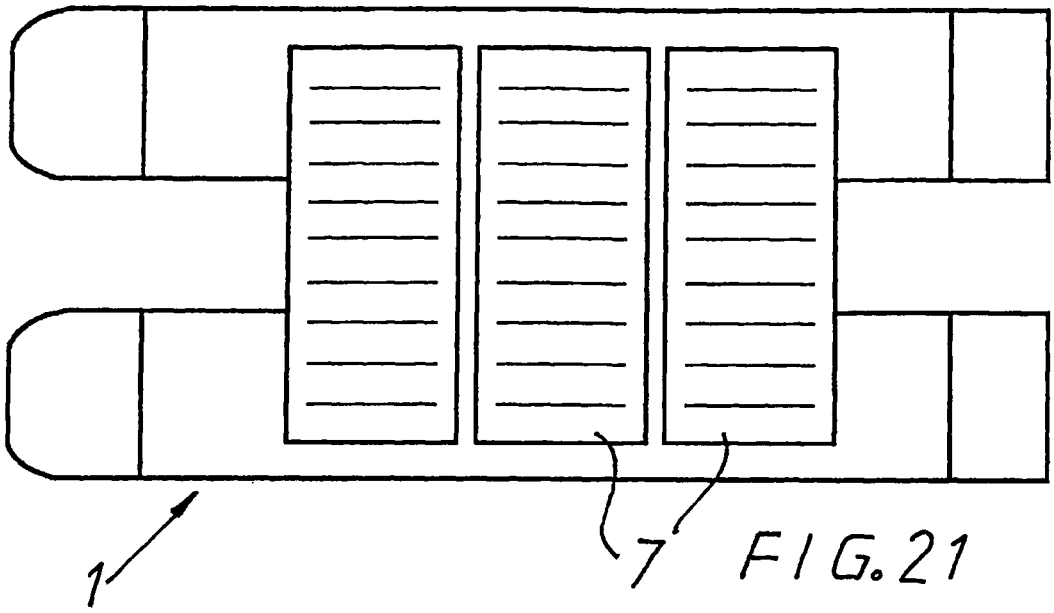
Figure 22:
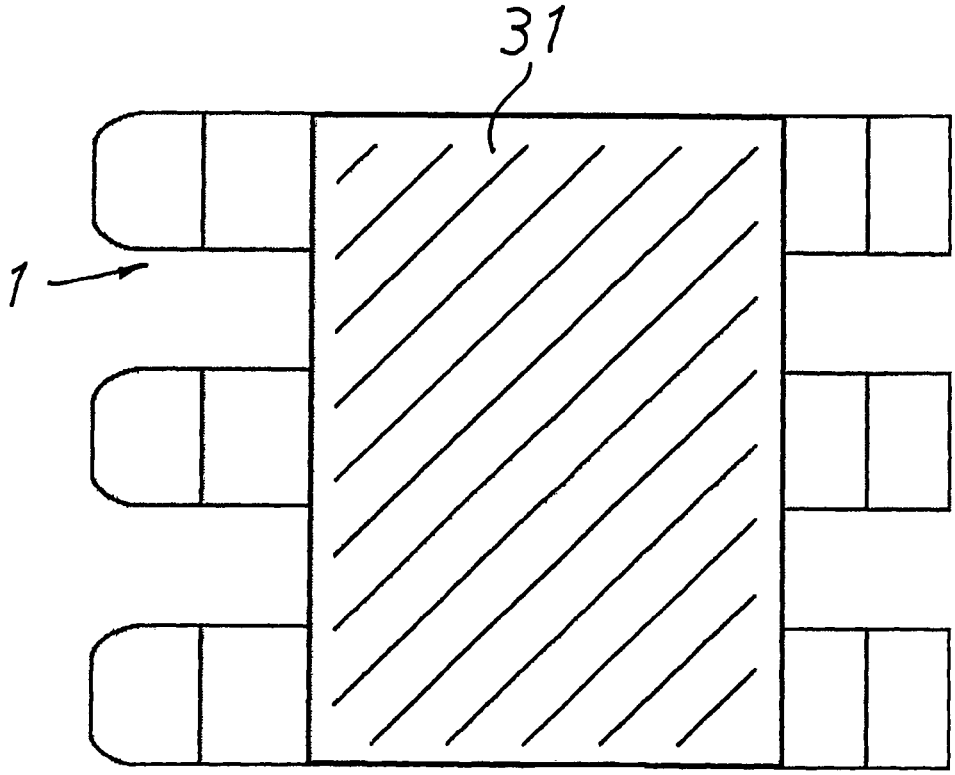
Figure 23:
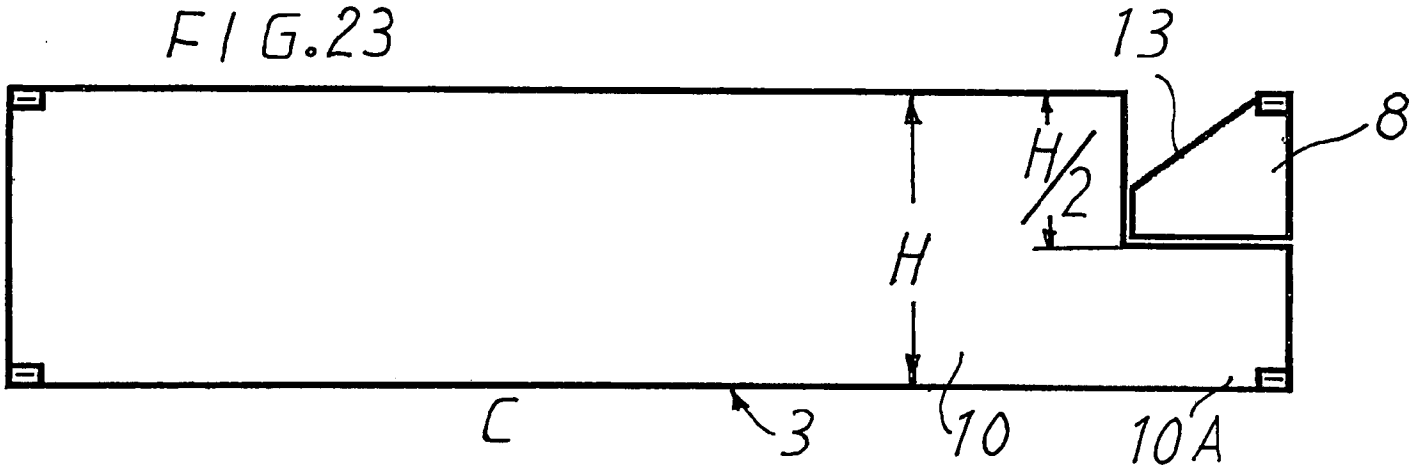
Figure 24:
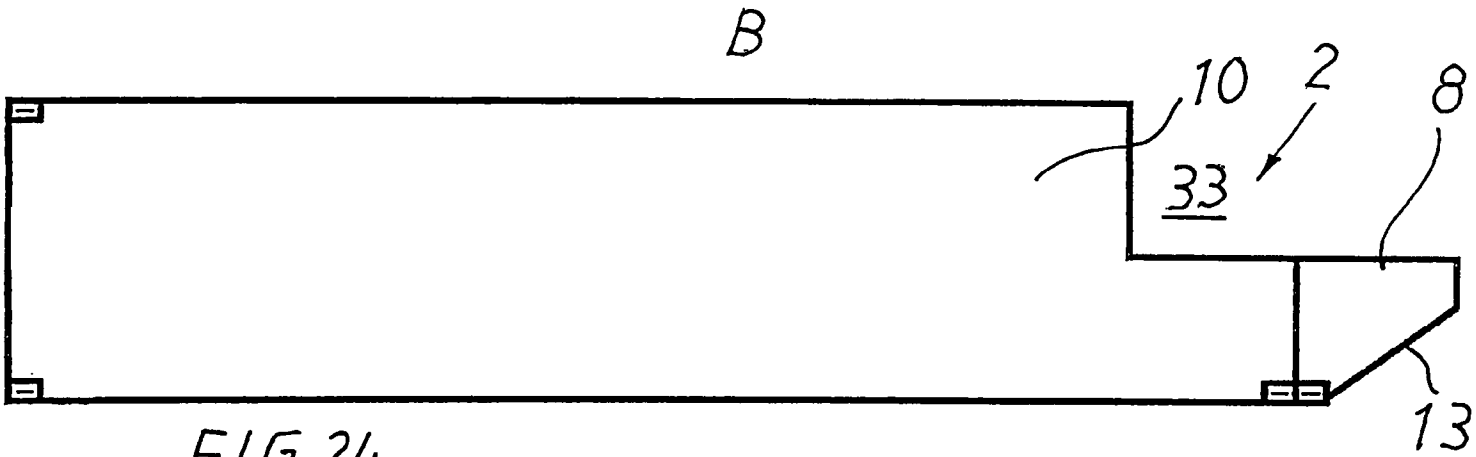
Figure 25:
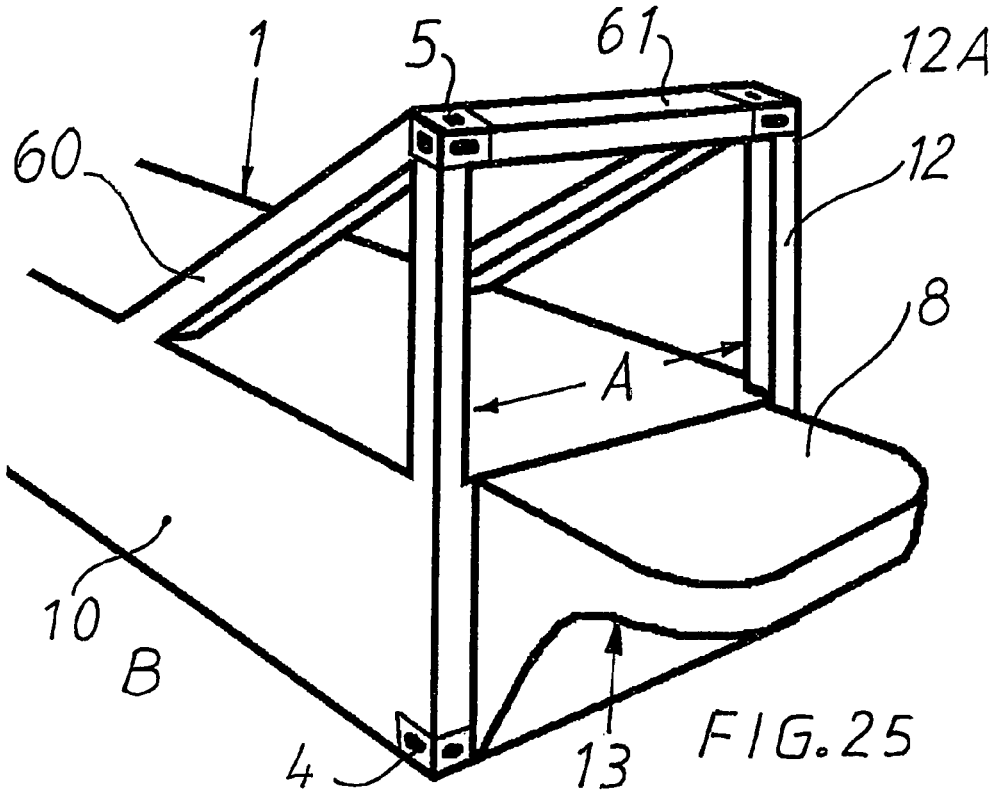
Figure 26:
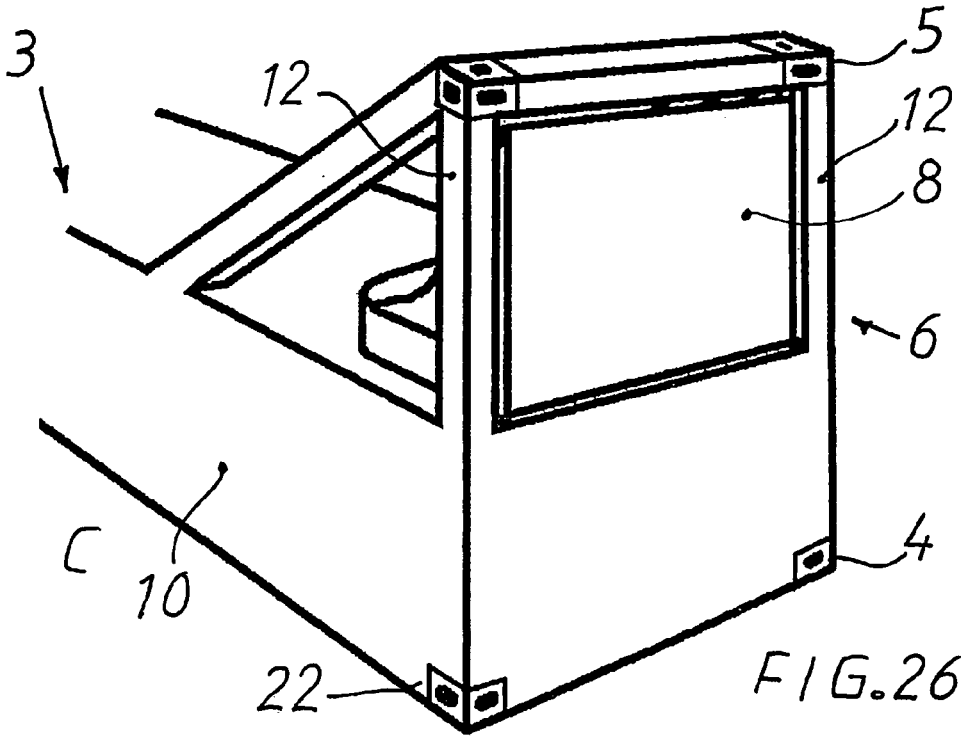
Figure 27:
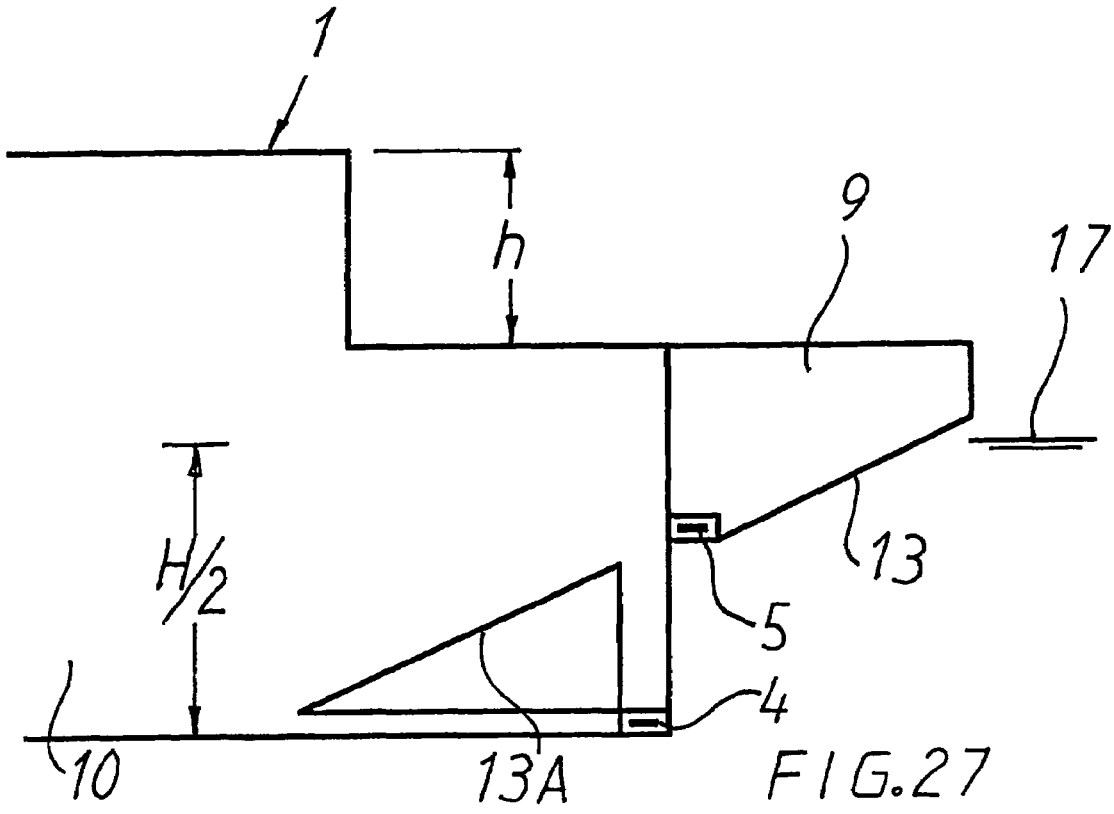
Figure 28:
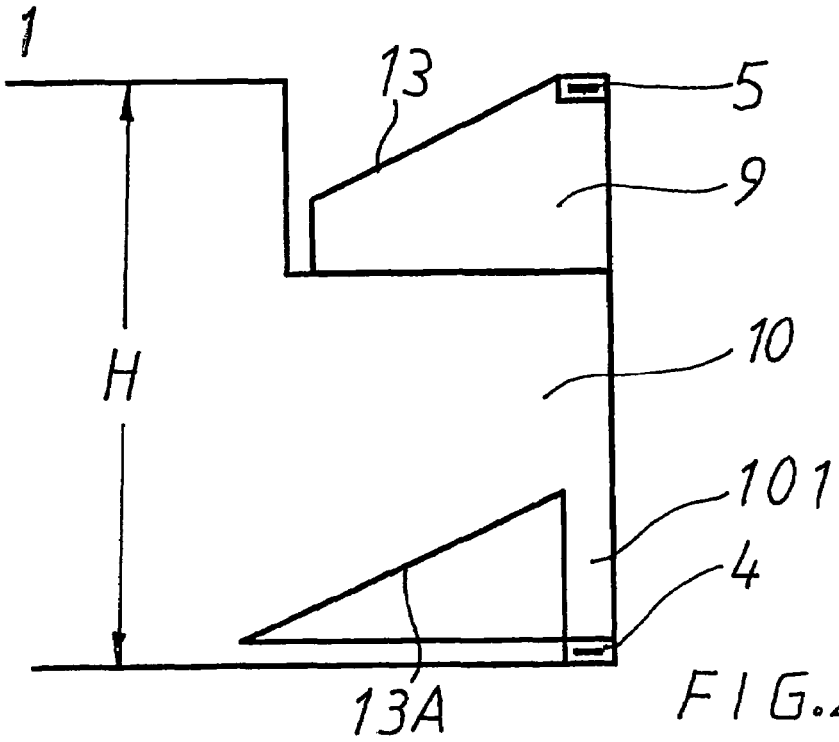
Figure 29:
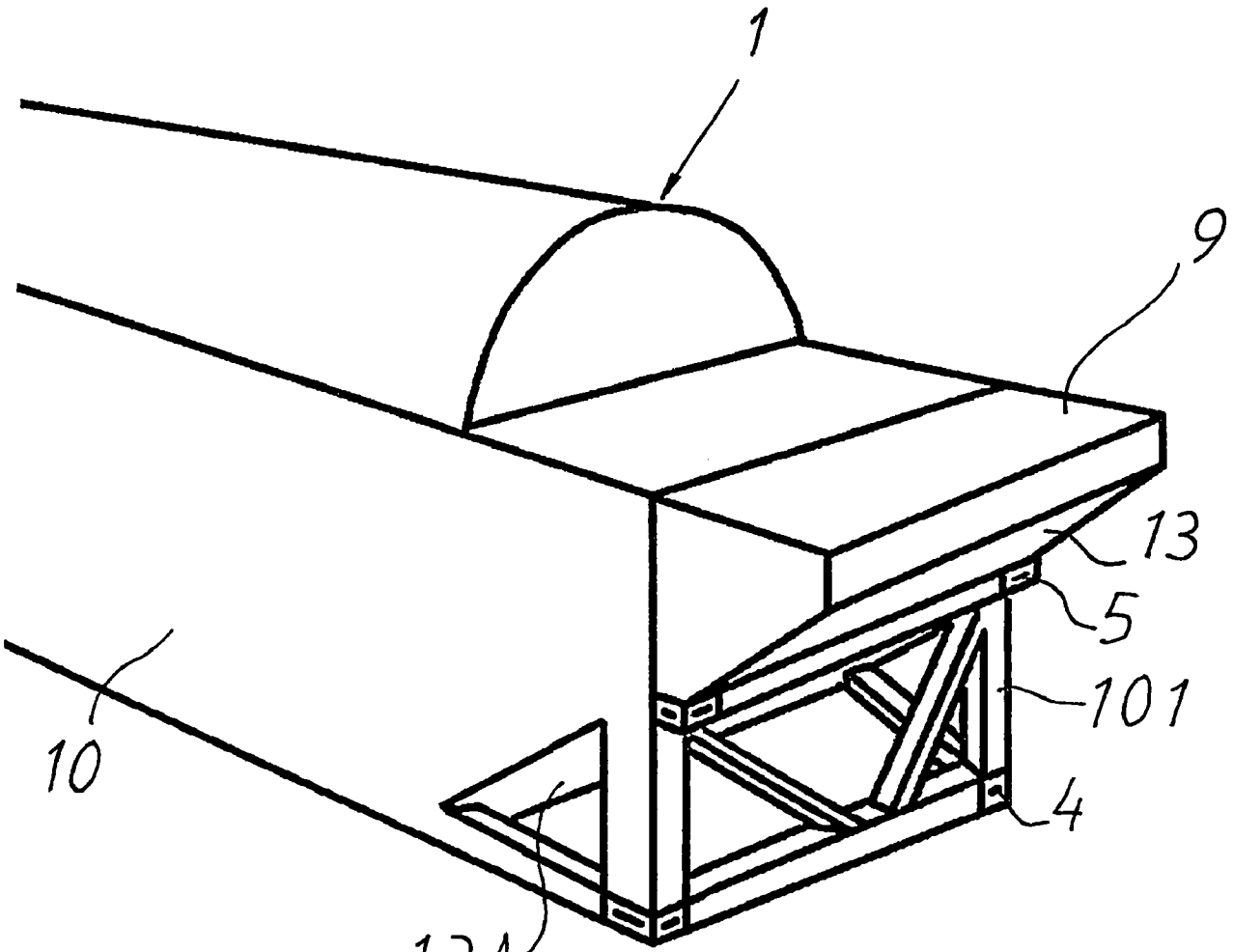
Figure 30:
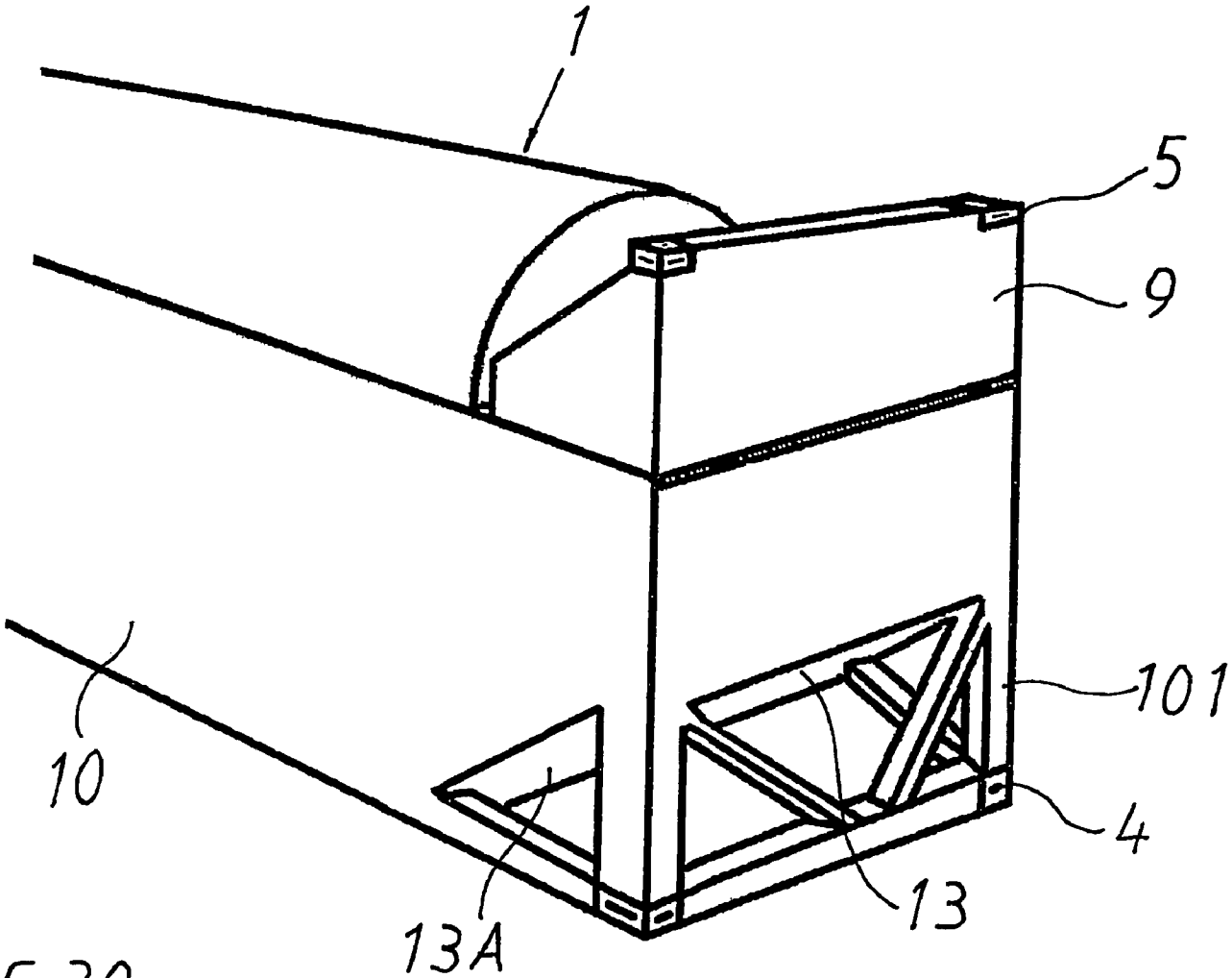
Figure 31:
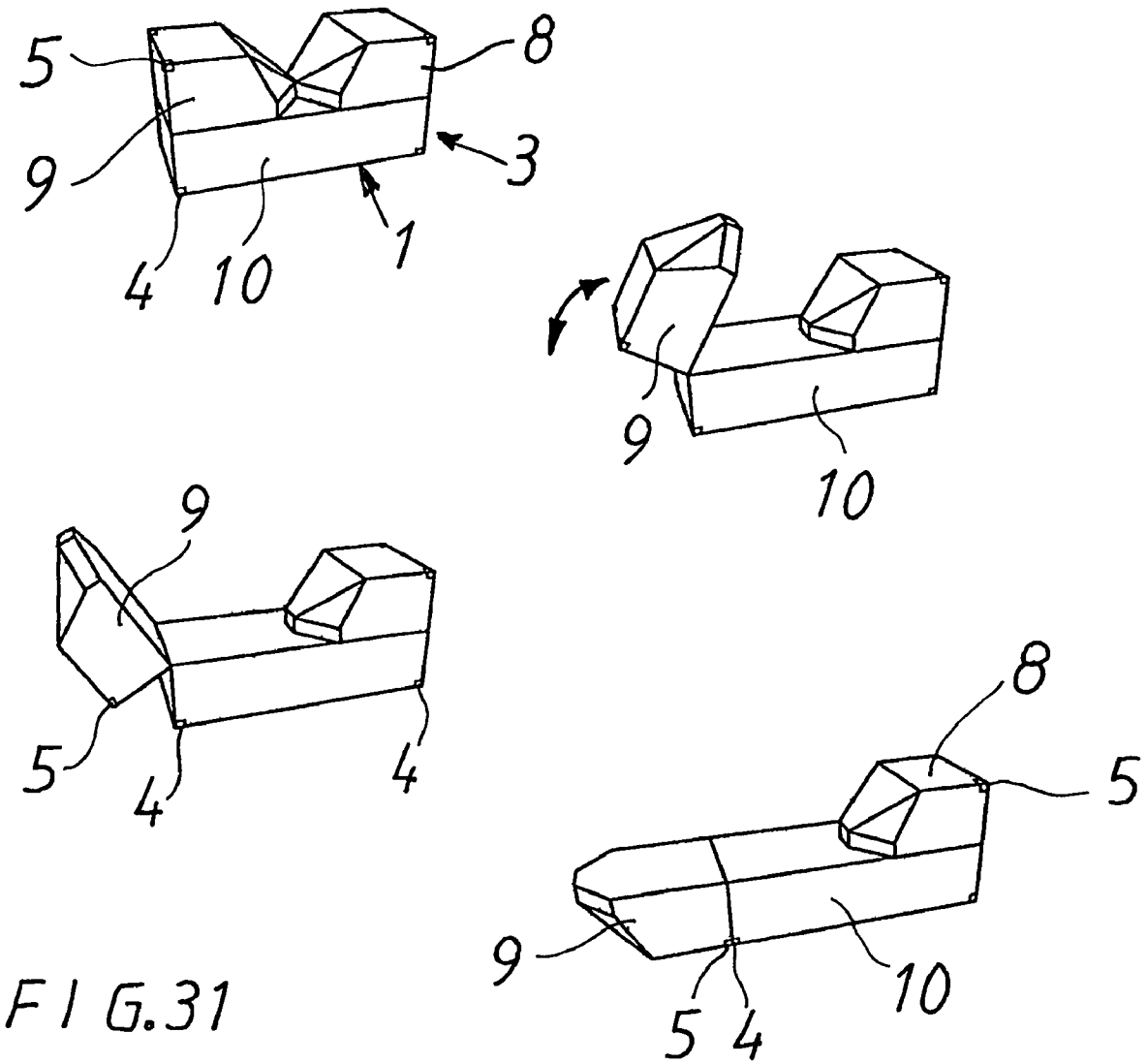
Figure 32:
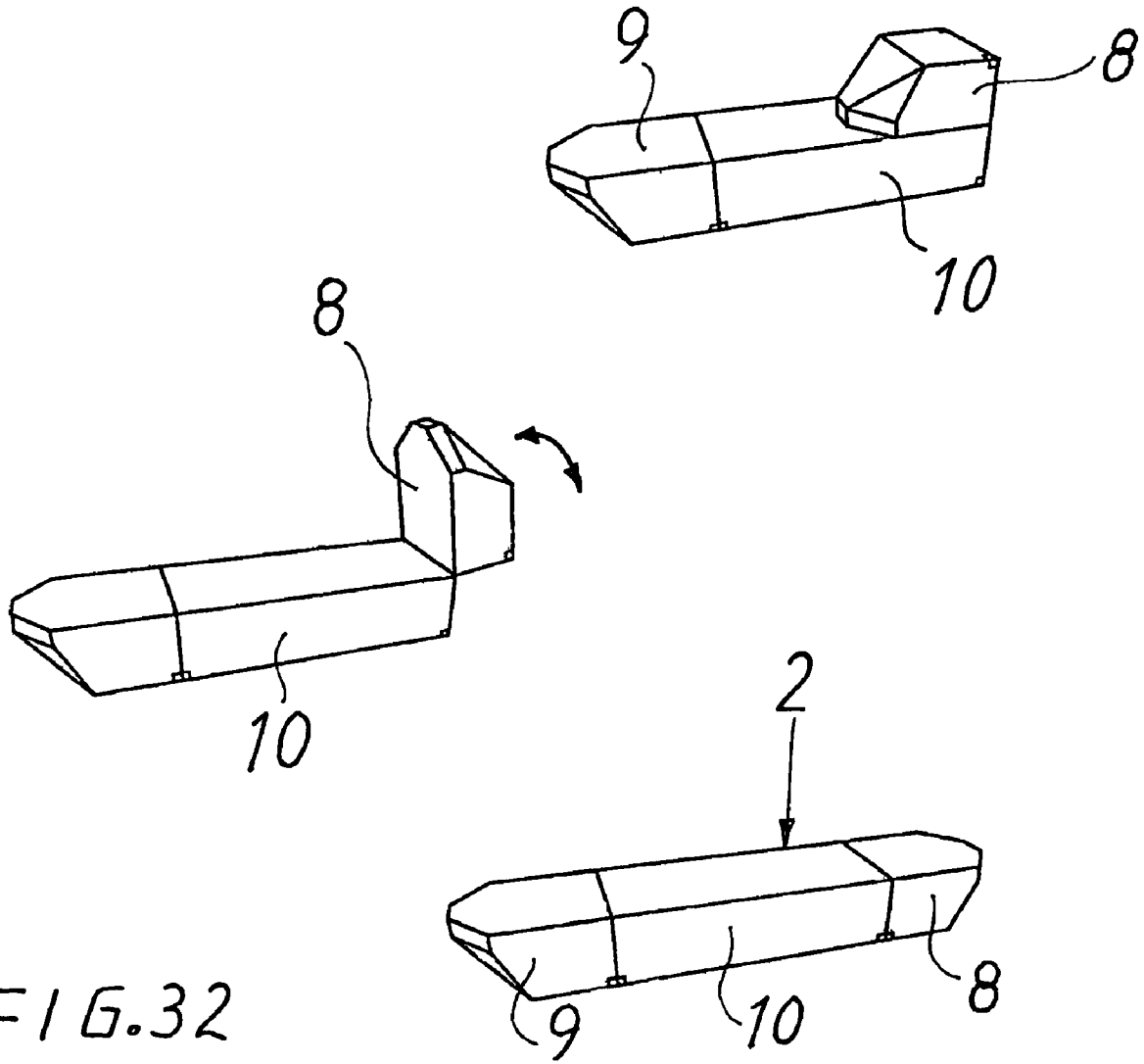
Figure 33:
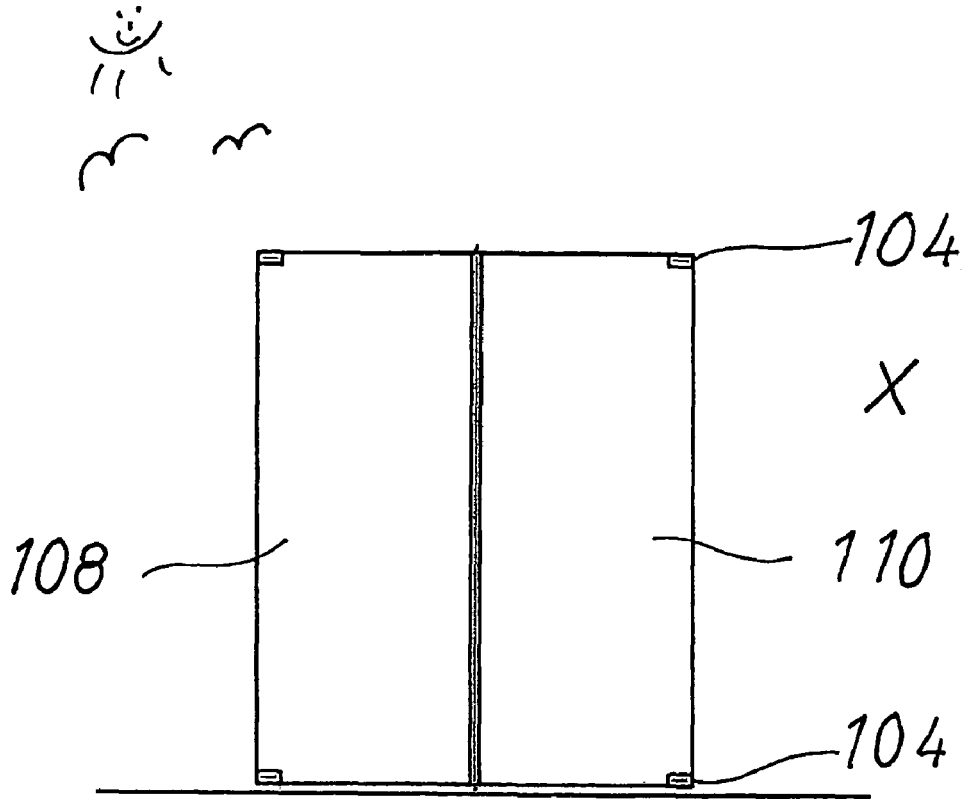
Figure 34:
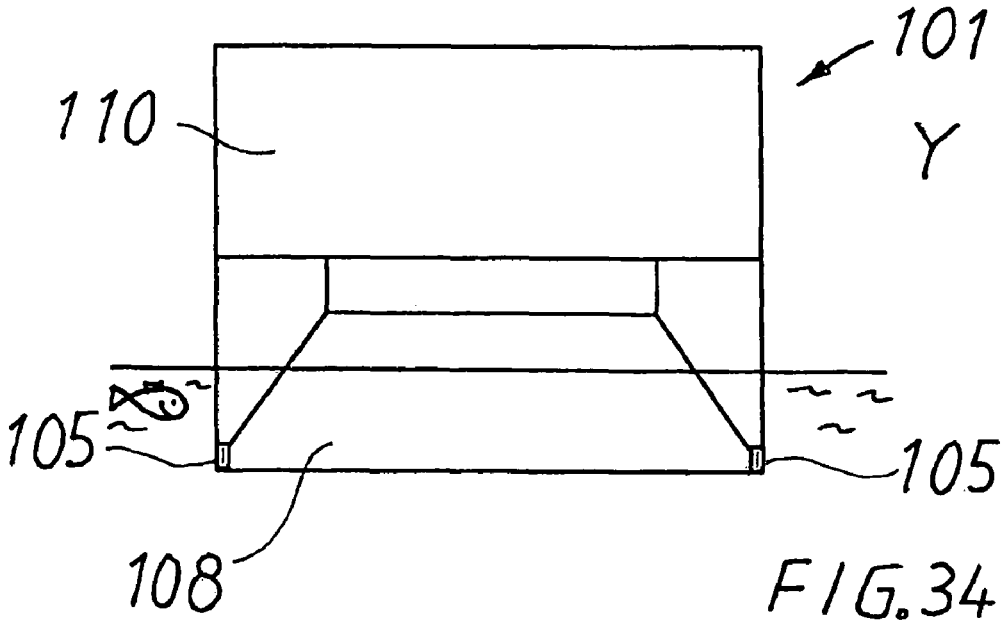
Figure 35:
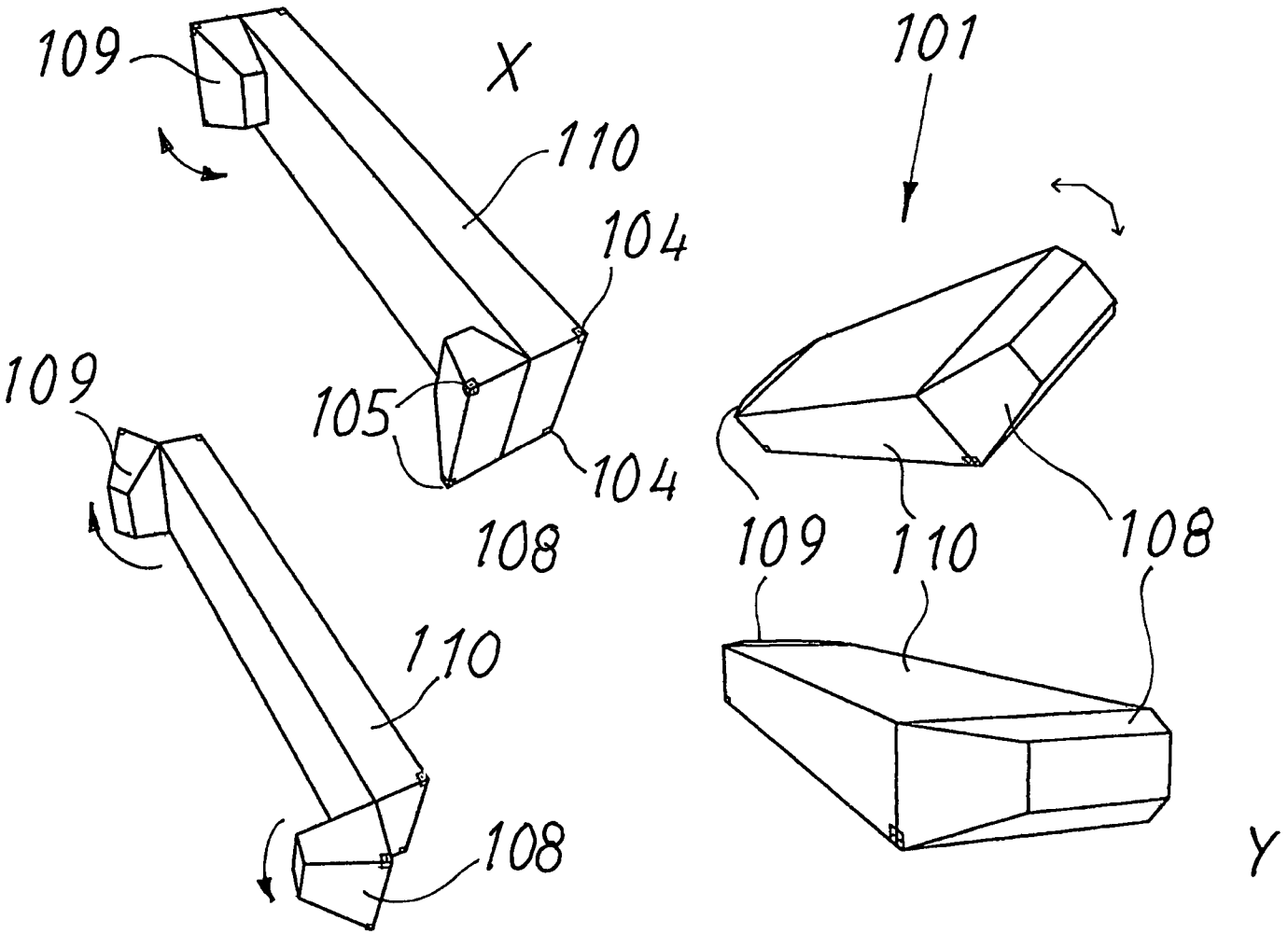
Figure 36:
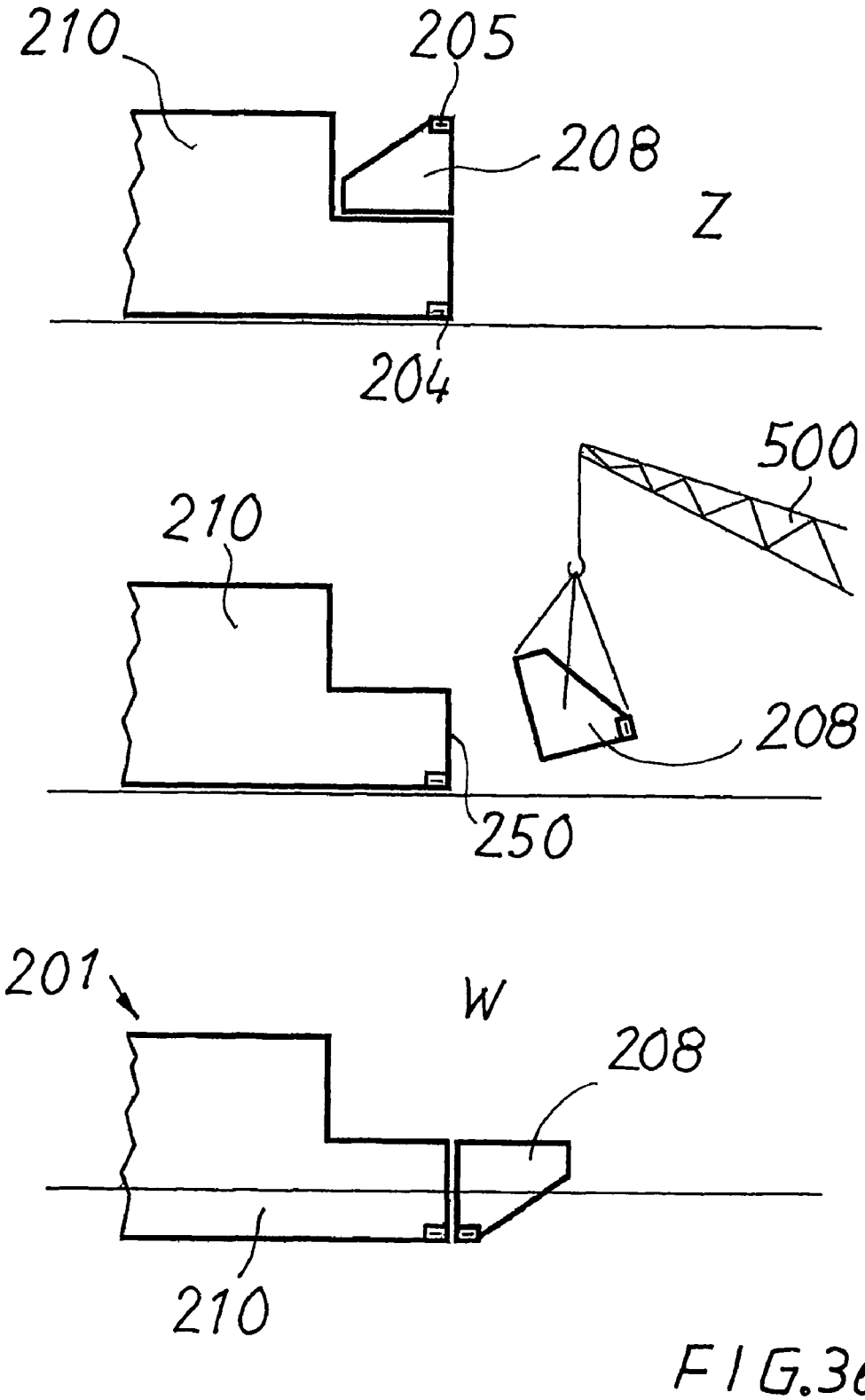

The invention is described below in the form of a number of preferred embodiment examples, reference being made to the accompanying drawings in which;

FIG. 1 shows the invention transformed into a container and in the middle of a container stack, FIG. 2 shows the transformation stage of the present container craft, FIG. 3 shows the invention ready-transformed into a craft, FIG. 4 shows a view from above of the invention in a raised container state, FIG. 5 shows one end part of the invention in an entirely raised stacking-ready state, FIG. 6 shows examples of the design of the underwater parts of the hull, FIGS. 7-11 show different examples of driving arrangements for the craft, FIGS. 12-13 show different sizes of crafts, FIGS. 14-15 show additional examples of different craft types, FIG. 16 shows a craft formed as a container, FIGS. 17-22 show additional examples of different craft types, FIGS. 23-24 show examples of a simple turnable end part with the end part in the raised and in the lowered state, respectively, FIGS. 25-26 show support arrangements for container stacking at a craft end part with the end part in the turned-down and turned-up state, respectively, FIGS. 27-28 show schematic side views of an end part in the lowered and raised state, respectively, FIGS. 29-30 show perspective views of said end part in said lowered and raised state, respectively, FIGS. 31-32 show overall the course of events upon the craft's turning of pair-wise end parts from a stackable unit into a completed craft, FIGS. 33-35 show examples of a variant of a transformable craft in different states, and FIG. 36 shows examples of an additional variant of a transformable craft having a liftable and interconnectable end part.

When the craft is adapted to container transportation intended for stacking onboard larger ships and then is classified as a container, the transportation costs are substantially reduced and the logistics of the transformable craft—which in the moved state transformed into a craft provided with end parts is classified as craft—is radically simplified.

A transformable craft 1 according to the present invention is both a boat 2 and a container 3. It is possible to convert it from a container 3 into a boat 2 and vice versa both ashore and in water. The procedure is simple and quick and can be carried out manually, mechanically, hydraulically or by other technique. No additional fittings need to be screwed onto the hull/container, and all that is needed for the conversion are already in the construction. When the craft 1 is a boat 2, it has a design that is attractive to the eye and it is not seen that it also is a container 3. The boats are classified according to the standards that apply to the boat type, and meet established requirements of safety and performance.

When a craft 1 is converted into a container 3, it is usually to be regarded as a classified container and it is usually also handled as such and not as a boat. In the construction, there are fixed and movable container fittings 4, 5, so-called corner fittings, respectively, which are adapted to ISO standards such as, for instance, ISO 668:1988, ISO 830:1981, ISO 1161:1984 and ISO 6346:1984 and/or other container standards. Said fittings 4, 5 makes it possible to couple together and stack a craft 1 with other classified containers 7, such as shown as an example in FIG. 1.

A device 6 at a transformable craft 1 that, in the respective transformed state B and C, respectively, is arranged to function as floating ship, boat, etc., 2 and, together with additional transformable crafts 1 and/or containers 7, as a unit 3 intended for stacking, respectively, a number of parts 8, 9 of the craft 1 being movably actuatable for the transformation into a ship 2 and into a unit 3 intended for stacking, respectively, comprises at least one end part 8, 9 of the craft 1 that is lowerable and raisable, respectively, and turnably mounted to a middle part 10 of the craft 1. According to the invention, said end part is arranged to form an extension of the middle part, and that said turnable end part 8, 9 and/or supports 12 of the middle part 10 support container fittings 5, and that said end part 8, 9 has a ship-adjusted shape 13.

A said end part 8, 9 is formed of an upper part of said container-forming unit 3 intended for stacking.

In the drawings, it is shown in FIGS. 1-22 that mutually opposite end parts 8, 9 are lowerably 14 and turnably, and raisably 15 and turnably, respectively, mounted to the middle part 10 of the craft 1, while in the drawings in FIGS. 23-26, it is shown that only one end part 8 is mounted lowerably and raisably, respectively, and turnably to the middle part 10 of the craft, either in the stem or in the stern.

One of said end parts or both end parts 8, 9 has/have a ship-adjusted shape, at least one of them having a tapering shape 13 in order to provide good hydrodynamic properties and good fluid mechanics. In the drawings, examples are shown in FIG. 6 of how the underwater hull of the craft 1 may be formed in order to obtain desired good properties. With tapering shape 13, it should, in the text and in the drawings, be appreciated wedge-shape as seen vertically and/or acute or chamfered shape as seen from above.

A conventional container 7 and also the present craft 1 when the end part 8, the end parts 8, 9 are in the raised storage state I have poor hydrodynamic properties and could be hard to be drivable as a boat in water 17. Thus, here the occurring end part/end parts has/have an important key role in order to give the craft 1 good fluid mechanics and propulsion capacity in the water 17. This is shown, among other things, in FIG. 3, where the craft 1 transformed into the form of ship 2 is run in the direction of travel 16.

Figure 7:
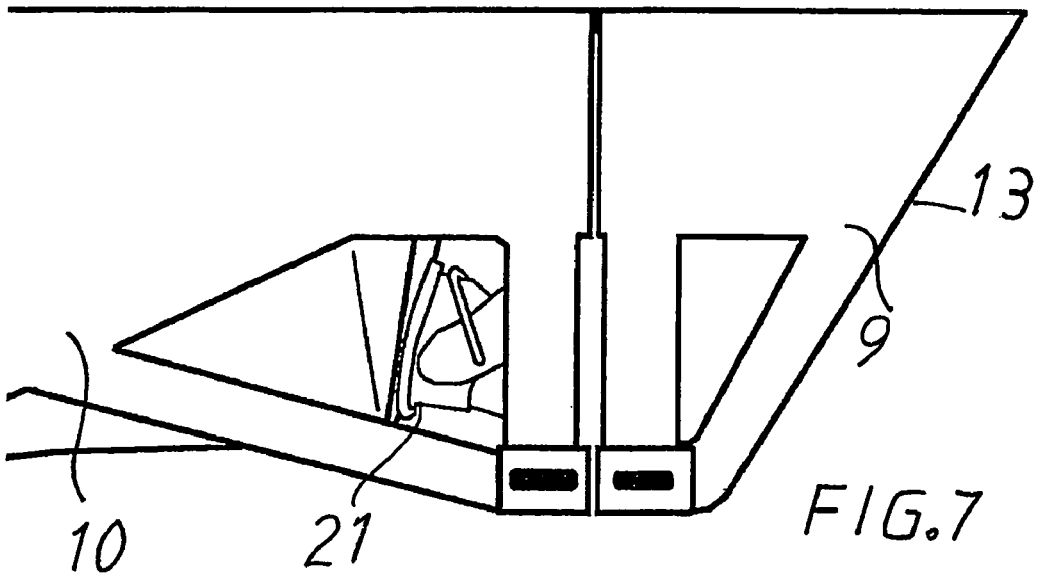
Figure 8:
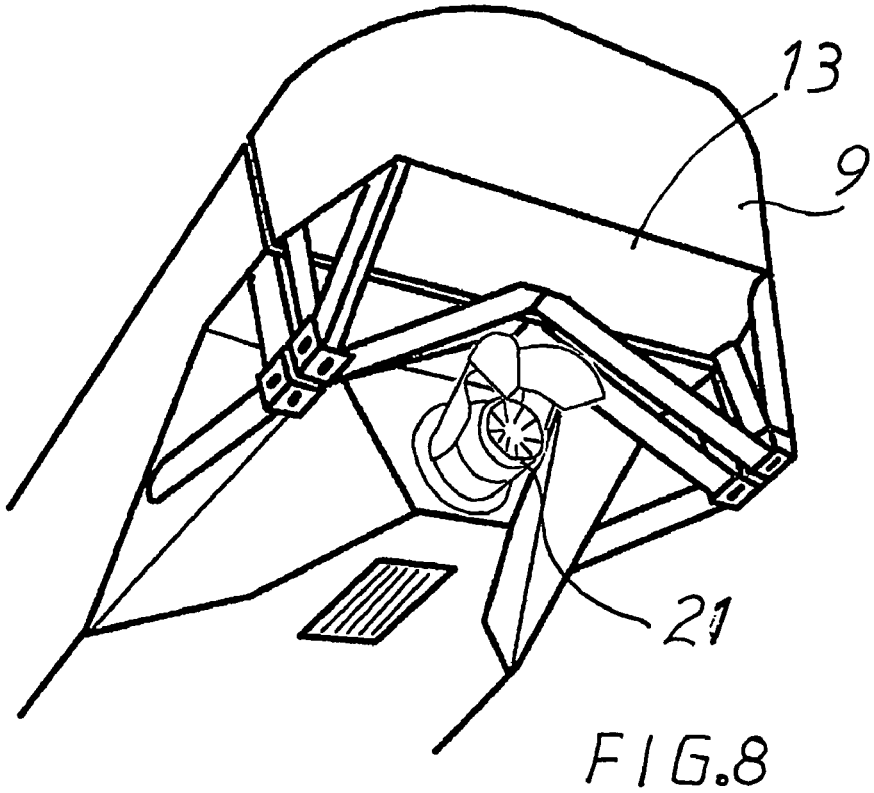
Figure 9:
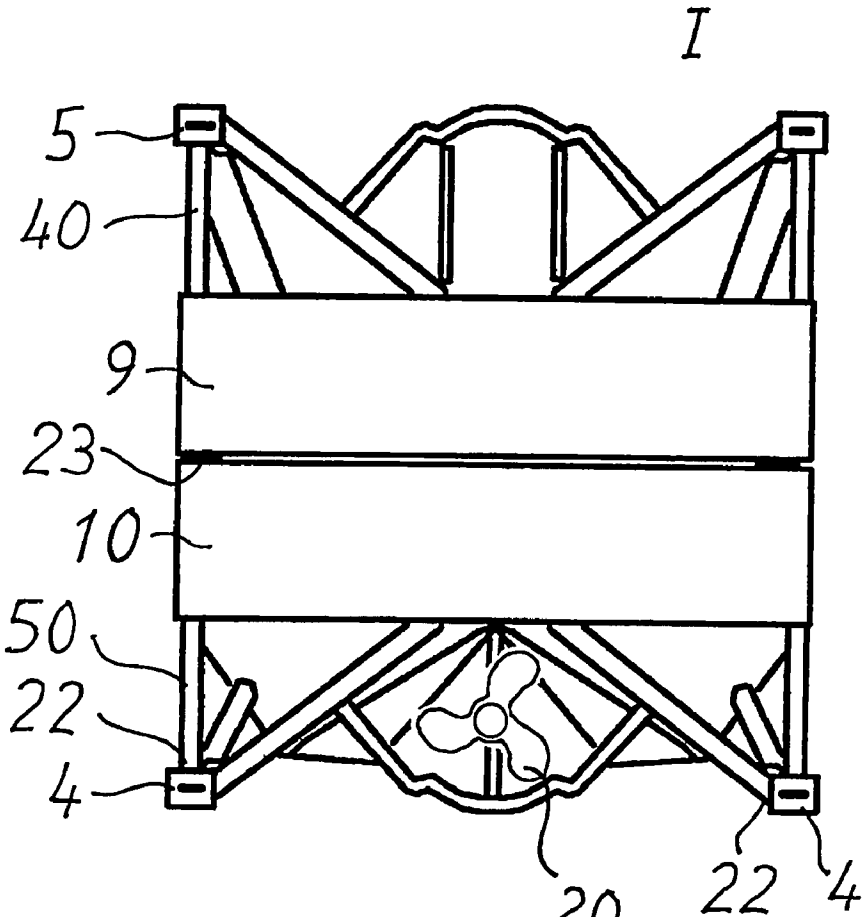

In order to be able to propel the craft 1 by its own engines and not in the form of a towed barge or the like, a driving part 18 is arranged supported by at least one end part 9 and/or the middle part 10 of the ship 2. Preferably, the craft 1 is equipped with an engine 19, propeller 20 and rudder 11 or the corresponding, but it may also be driven by water jet, pump jet or by different kinds of pinions, etc. Said driving parts may be fitted in the middle part 10, in the stern 9, in the stem 8 or as a combination thereof. FIG. 2 shows an engine 19 and propeller 20 fitted in the stern 9, while FIGS. 7-8 show examples with a water-jet driving member 21 fitted in the middle part 10, while FIGS. 9-10 show examples of a propeller 20 and engine 19 fitted in the middle portion 10 and with the stern portion in the raised storage state I. Finally, FIG. 11 shows an example of a propeller fitted in the middle portion 10 and with the stern portion 9 in the lowered state II.

The design of the middle portion 10 may be varied significantly with the exception of the placement of the fixedly situated container fittings 4 in the lower corners 22 of the preferably quadrangular circumference shape of the middle part 10, as seen from above and/or from the side. The design of the end parts 8, 9 may also be varied within wide ranges with the exception of the placement of the movable or fixed container fittings 5. This means that the middle portion 10, for example, may be built as a ferry, barge, tanker, houseboat, work platform or motorboat with or without cabin and superstructure. The layout and arrangement of the different inner spaces of the boat, such as the engine room, holds, galley, cabins, etc., may be varied unlimitedly depending on the field of application of the boat. In the drawings, different shapes and fields of application can be seen. In order to be able to stack and allow the craft 1 in question, in the collapsed state I as a unit 3 intended for stacking, be able to carry load, said turnable end part 8, 9 has a load-carrying support unit 40 situated in vertical alignment with the outer and mutually opposite, respectively, parallel end-edge portion of the ship, which, together with aligned fixed supports 50 situated underneath, can transfer the load F from a stacked conventional container 7 situated above and/or a craft 1 according to the invention. See for instance FIG. 5.

A variant of this is shown as examples in FIGS. 25-26, where the supports 12 in the form of pair-wise uprights situated at a mutual distance A from each other at the end edges of the middle part and possibly reinforced with support struts 60, 61. In this arrangement, in the turned-up state, a turnable end part 9 is receivable between said upright standing uprights 12 transferring load downward. Said uprights 12 have fixed container fittings 5 at the ends 12A on a common level as well as that lower fixed container fittings 4 are present at the respective corners 22 of the middle part 10.

Said container fittings are primarily intended to function as fittings upon locking of containers to intended sites for transportation or at container lifting facilities in harbours, etc. However, they could be usable to lock the turnable end parts 8, 9 firmly to the middle part 10, since they, as is shown in the drawings, may arrive in a position next to each other. See for instance FIG. 7. Said support struts 60, 61 having supporting container fittings 5 may be loosely attachable to the end part/end parts before or after it has/they have been turned into the intended storage state.

A said end part 8, 9 has a pivot mounting 23, which for instance is situated at half the height H/2 of the craft as seen when the craft is in the state C thereof intended for stacking. Furthermore, detachable arresting members are present between the intermediate part 10 and the end part 8, 9, which members may be manual or work automatically and allow to hold the end part/end parts 8, 9 in the intended desired arrested or disengaged state for use as a craft 1 and for storage as a unit 3 intended for stacking, respectively, i.e., B and C, respectively. See FIGS. 24 and 23, respectively.

Another height of the end part/end parts 8, 9 may also be chosen. In the drawings, an end-part height h less than half the height H/2 of the middle part 10 is shown as additional examples in FIGS. 27-30. The shown example shows a height h of the end part that is approximately ⅓ of the height H of the middle part. However, a suitable height is adapted to the hydrodynamic properties of the craft 1. Thus, the downwardly facing surface 13 of said end part in the water 17 may form or essentially form a smooth continuation of the likewise hydrodynamic hull end shape 13A of the middle part 10, such as shown in FIGS. 27 and 29.

The important thing is, as has been said above, that the upper container fittings 5 arrive on the correct level when the end part 9/end parts is/are held in the turned-up storage state, such as shown as examples in FIGS. 28 and 30. In the example shown, the middle part 10 forms a tank reservoir for the receipt of suitable goods therein.

Thus, the effective height of the end part/end parts 9 may be chosen according to the desirable properties of the craft 1, ashore 100 as well as in the water 17.

An alternative solution is that the end part is stored displaceable to a desired level by means suitable therefor, or that bridging members are arranged between the middle part and the end part/end parts in order to further increase the hydrodynamic properties of the craft when it is run in water. In the example shown, the lower fixed container fittings 4 are attached on downwardly projecting uprights 101 that are fixed or mountable when to be used, or other supports.

The middle part 10 of the craft 1 has a space for cargo of some type, and this space as well as the cargo may vary substantially. As an example, it may be mentioned that it may be formed of a living space onboard said craft 1, for instance as is shown in FIGS. 12-14, while then a part of the turnable end part/end parts 8, 9 is/are arranged to form a deck 24 onboard the craft 1. Parts 25 projecting outside the intended cargo profile in the collapsed storage and stacking state C may, in that connection, be made foldable and/or easily mountable.

The field of application of the present craft 1 is limited by the sizes, which in turn is regulated by the standard sizes of containers, e.g., 20 and 40 ft, and shown in FIGS. 13 and 12, respectively, as a motorboat 2 as seen both from the side and from above, and only from the side, respectively. It is only the fantasy and demand that limits the possible use of the craft 1.

Figure 17:
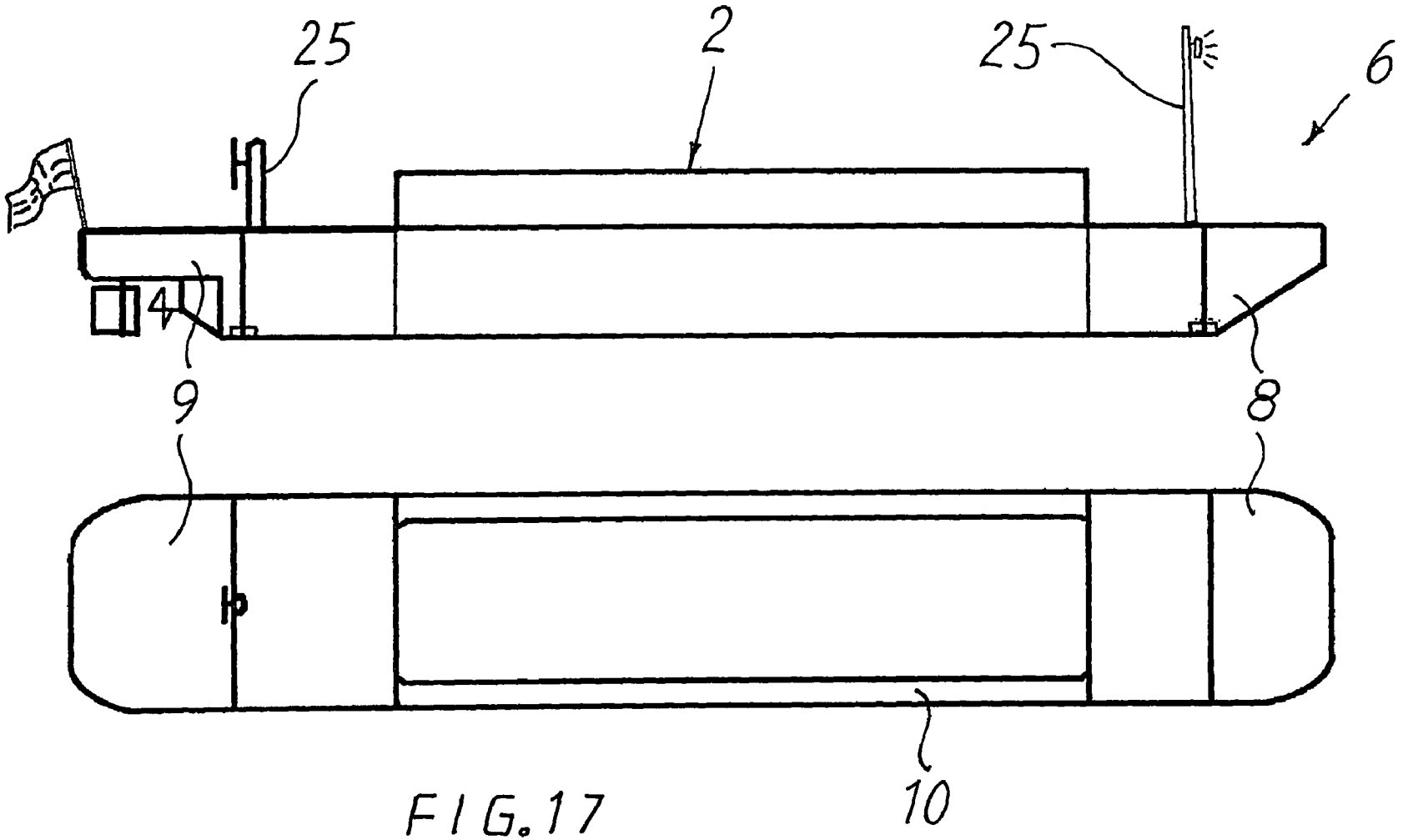
Figure 18:
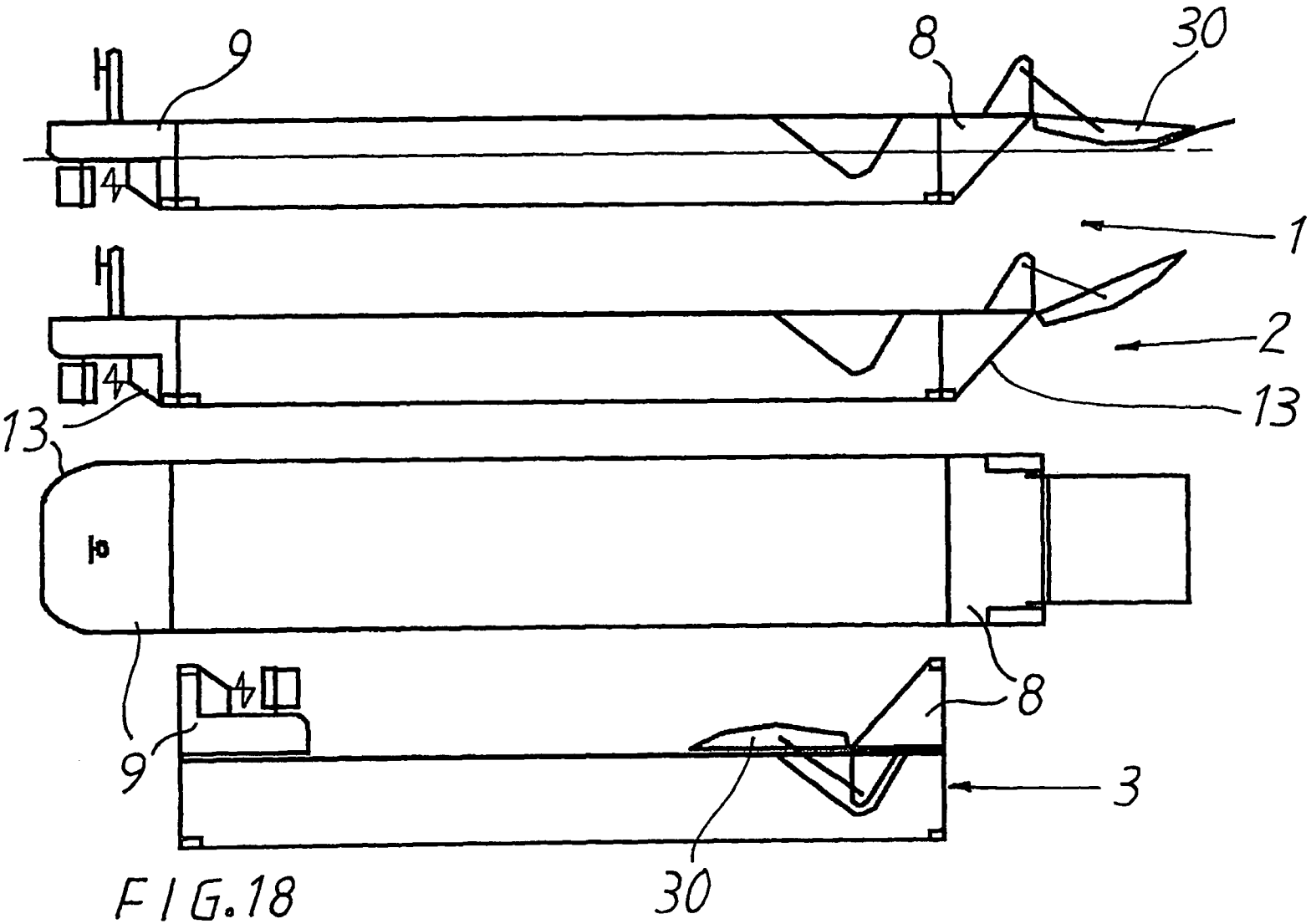
Figure 19:
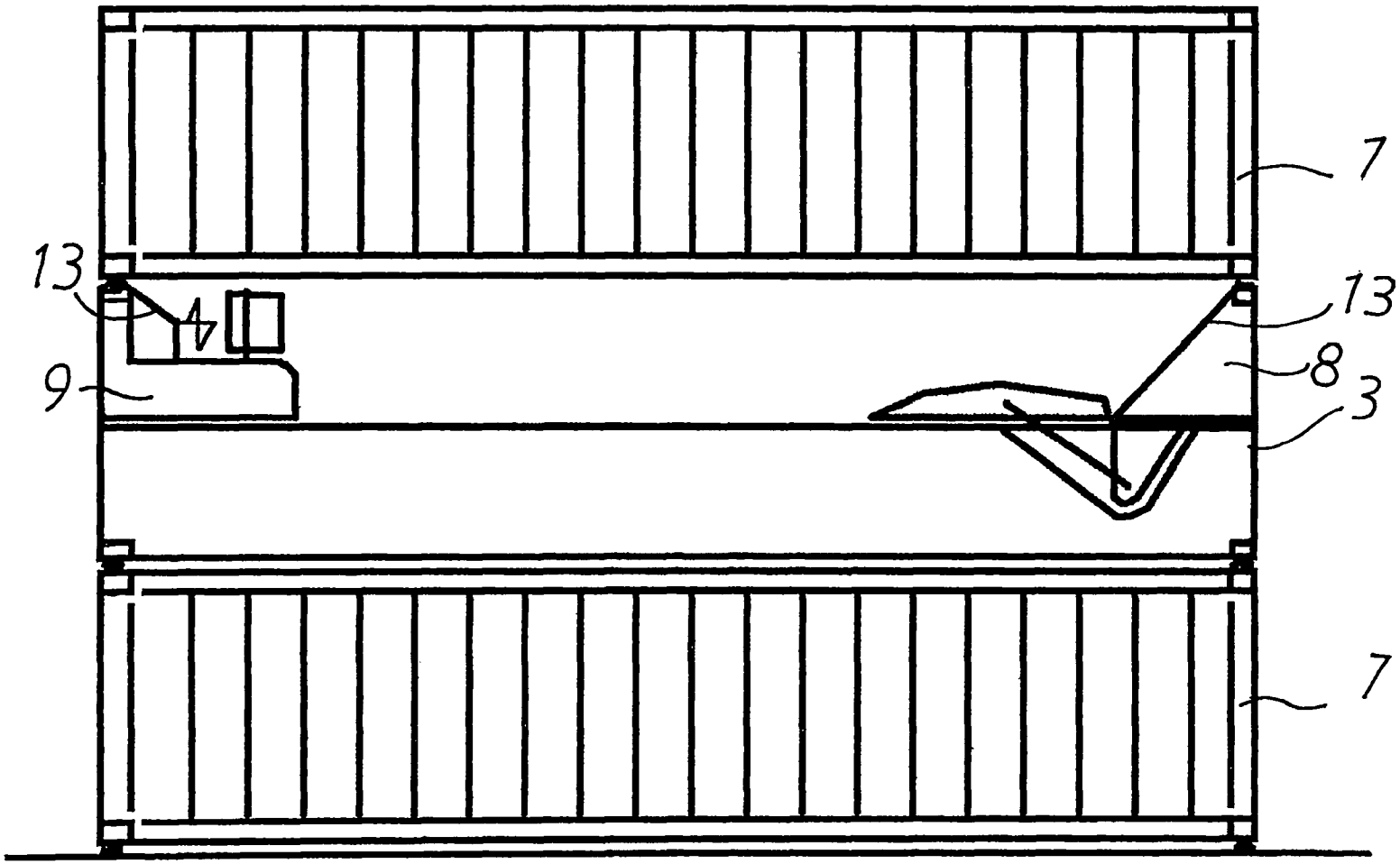
Figure 20:
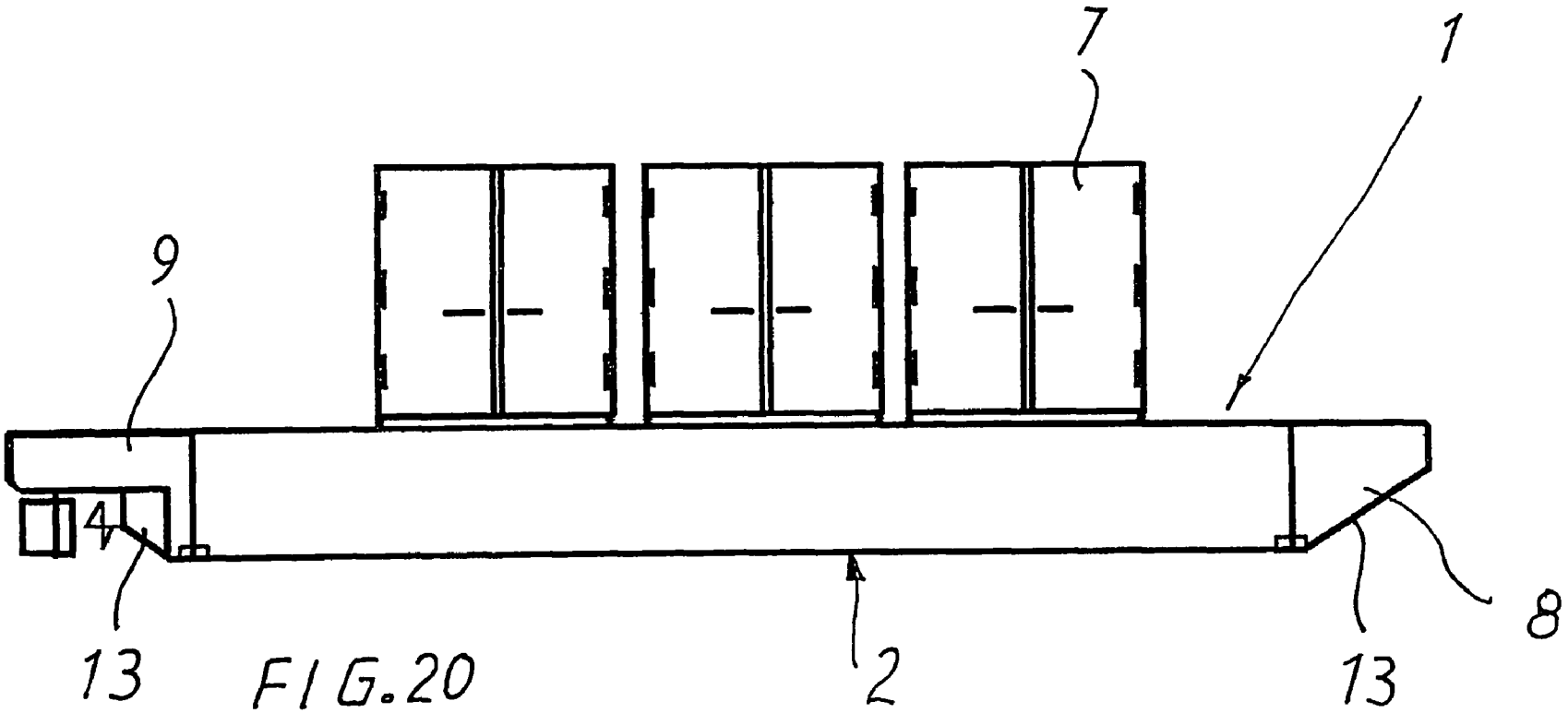

In the drawings, different variants of feasible solutions are shown:

- A traditional canal boat/houseboat in Dutch, English or another style is shown in FIG. 14,
- An office and/or a floating work shed for the building trade is shown in FIG. 15,
- A barge with or without an engine and having an open middle portion that works as hold is shown in FIG. 17. An open middle portion works as hold. Double sides are formed as closed air tanks and works as hulls. A waterproof stowage is present in the stem. An entirely closed and waterproof engine room having air-intake is situated high up in the binnacle. It is possible to adapt for transportation of dredged bottom material by building in a longitudinal closable opening in the bottom of the hold.
- A ferry 1 having straight lines in the stem and equipped with a foldable ramp 30 is shown in FIG. 18,
- A ferry stored collapsed between two stacked containers 7 is shown in FIG. 19,
- A catamaran for transportation of containers, work sheds, work platforms, etc., is shown in FIGS. 20 and 21.
- FIG. 22 shows in a view from above how a number of crafts 1 can be coupled together to carry a work platform 31.
- FIGS. 25 and 26 show an alternative solution for how a foldable end part 8, at least one of them, is foldably mounted between container fittings 5 that are fixedly fitted in support uprights 12. Said support uprights 12 may be fixedly fitted to the middle part 10 in question or be loosely fitted to the middle part 10 in question.

The main idea of the invention is that the construction consists of two or three sections held together. More precisely, it is formed of a tight floatable middle part 10, and an end part 8 arranged at one end 10A of said middle part 10 or an end part 8, 9 arranged at the mutually opposite ends 10A and 10B, respectively, of said middle part 10. See for instance FIG. 23 and FIG. 3, respectively.

When said end part 8/end parts 8, 9 is/are in the folded-out state, the unit forms a craft and then the end parts 8, 9 constitute an extension of the middle part 10. The end parts 8, 9 can be turned up 180° and be fitted into spaces 33, 34 intended therefor on the middle part 10. The result becomes a container.

Thus, the maximum length and width of the middle portion 10 is determined by the standard codes for different container types. The end parts 8, 9 may have the same shape or a different shape depending on the boat model desired. Four container fittings 4 are placed in the corners underneath the rectangular middle portion 10. FIG. 3 shows the fittings 4 on one of the sides of the middle part 10. The end parts 8, 9 are provided with two container fittings 5 each. When the invention is a boat and the end parts 8, 9 are lowered, the container fittings 5 thereof are in the bottom. When it is a container and the end parts 8, 9 are raised, the container fittings 5 thereof are on the topside. Such as shown in FIGS. 4 and 5, they are applied on a raised end part.

A structure according to the invention is designed to meet all strength requirements made on a classified container. It has also design solutions that allow it to resist the stresses that it is subjected to as a boat. The result becomes a very strong and durable unit, both when it is in the container state 3,C and when it is a boat 2,B.

In FIG. 31, examples are shown of how a "standing" craft 1 easily is transformed from a container-forming shape, suitable for stacking both downward and upward, into a boat form, suitable to propel in water as a boat 101. The two end parts 8, 9 are easily turned between the respective two end positions thereof as indicated above, and are provided with container fittings 5, while the middle part 10 has the container fittings 4 thereof at the bottom in the corners.

In FIGS. 33-35, it is shown how the middle part 110 is rotated 90° when it is used as container support, and the end parts 108, 109 then are laterally positioned in relation to the middle part 110 in order to, by the container fittings 105 thereof together with the container fittings 104 of the middle part 110, co-operate with downwardly and upwardly stacked containers. In the case of turned-out end parts 108, 109 and locking of the same to the middle part 110, the unit can be used as a craft 101 after it has turned 90° from an upended state X to a floating state Y.

Finally, in FIG. 36, examples are shown of a loose end part 208 that can be lifted, e.g., by a crane 500, from a supported state Z on a middle part 210 to a put-down state W for detachable connection with the terminating part 250 of the middle part 210, e.g., by bolts, not shown. Then a floatable craft 201 is also formed. Also the other end of the middle part can be provided with such an attachable, liftable end part as indicated above.

Naturally, the invention is not limited to the embodiments described above and shown in the accompanying drawings. Modifications are feasible, particularly as for the nature of the different parts, or by using an equivalent technique, without departing from the protection area of the invention, such as it is defined in the claims. In that connection, it should be appreciated that by end part is meant stem and/or stern.

The invention claimed is:

1. A device at a transformable craft that, in a first state, is arranged to function as a floating ship and, in a second state together with an additional container, as a unit intended for stacking, wherein a number of parts of the craft are movably actuatable for transforming the craft into the ship and into the unit intended for stacking, comprising at least one end part of the craft that is lowerable and raisable, respectively, and turnably mounted to a middle part of the craft thereby forming an extension of the middle part; wherein the middle part includes supports; container fittings are supported by at least one of the turnable end part and the supports of the middle part; and a height of the at least one end part is selectable by displaceably mounting the at least one end part at a desired level according to desired properties of the craft ashore and in water.

2. The device of claim 1, wherein the at least one end part is formed of an upper part of the unit intended for stacking.

3. The device of claim 2, wherein mutually opposite end parts are lowerable and raisable, respectively, and turnably mounted to the middle part of the craft.

4. The device of claim 3, wherein the at least one end part has a tapering shape.

5. The device of claim 1, further comprising a driving part that is supported by the at least one end part or the middle part.

6. The device of claim 1, wherein the at least one turnable end part has a load-carrying support unit situated in vertical alignment with an outer end-edge portion of the craft in order to transfer a load from at least one stacked container or craft situated above.

7. The device of claim 1, wherein the at least one end part has a pivot mounting that is situated at half the height of the craft.

8. The device of claim 1, wherein a height of the at least one end part is approximately ⅓ of a height of the middle part.

9. The device of claim 1, wherein the middle part of the craft has space for cargo.

10. The device of claim 9, wherein the middle part is arranged to form living space onboard the craft, and the at least one turnable end part is arranged to form a deck of the craft.

11. A device at a transformable craft that, in a first state, is arranged to function as floating ship and, in a second state together with an additional transformable craft, as a unit intended for stacking, wherein a number of parts of the craft are movably actuatable for transforming the craft into the ship and into the unit intended for stacking, comprising at least one end part of the craft that is laterally turnably mounted to a middle part of the craft thereby forming an extension of the middle part; wherein the middle part includes supports; container fittings are supported by at least one of the turnable end part and supports of the middle part; the craft has buoyancy in a state when it has been lowered from a stacking-ready vertical laterally positioned stacking state into a substantially horizontal floating state; and a height of the at least one end part is selectable by displaceably mounting the at least one end part at a desired level according to desired properties of the craft ashore and in water.

12. A device at a transformable craft that, in a first state, is arranged to function as floating ship and, in a second state with an additional transformable container, as a unit intended for stacking, wherein a number of parts are arranged for transforming the craft into the ship and into the unit intended for stacking, comprising at least one end part of the craft that is detachably interconnectable with a middle part of the craft thereby forming an extension of the middle part; wherein the middle part includes supports; at least one of the interconnectable end part and supports of the middle part support container fittings; and a height of the at least one end part is selectable by displaceably mounting the at least one end part at a desired level according to desired properties of the craft ashore and in water.

13. A device at a transformable craft that, in a first state, is arranged to function as floating ship and, in a second state together with an additional transformable craft, as a unit intended for stacking, wherein a number of parts of the craft are movably actuatable for transforming the craft into the ship and into the unit intended for stacking, comprising at least one end part of the craft that is laterally turnably mounted to a middle part of the craft thereby forming an extension of the middle part; wherein the middle part includes supports; container fittings are supported by at least one of the turnable end part and supports of the middle part; the craft has buoyancy in a state when it has been lowered from a stacking-ready vertical laterally positioned stacking state into a substantially horizontal floating state; and the at least one turnable end part is receivable between pair-wise uprights standing upright from the middle part of the craft and having elevated container fittings on a common level.

14. A device at a transformable craft that, in a first state, is arranged to function as floating ship and, in a second state with an additional transformable container, as a unit intended for stacking, wherein a number of parts are arranged for transforming the craft into the ship and into the unit intended for stacking, comprising at least one end part of the craft that is detachably interconnectable with a middle part of the craft thereby forming an extension of the middle part; wherein the middle part includes supports; at least one of the interconnectable end part and supports of the middle part support container fittings; and at least one turnable end part is receivable between pair-wise uprights standing upright from the middle part of the craft and having elevated container fittings on a common level.

15. A device at a transformable craft that, in a first state, is arranged to function as a floating ship and, in a second state together with an additional container, as a unit intended for stacking, wherein a number of parts of the craft are movably actuatable for transforming the craft into the ship and into the unit intended for stacking, comprising at least one end part of the craft that is lowerable and raisable, respectively, and turnably mounted to a middle part of the craft thereby forming an extension of the middle part; wherein the middle part includes supports; container fittings are supported by at least one of the turnable end part and the supports of the middle part; and at least one turnable end part is receivable between pair-wise uprights standing upright from the middle part of the craft and having elevated container fittings on a common level.

* * * * *